US011391074B2

(12) United States Patent
Carbone et al.

(10) Patent No.: US 11,391,074 B2
(45) Date of Patent: Jul. 19, 2022

(54) DOOR HINGE AND STORAGE UNIT INCLUDING SUCH A DOOR HINGE

(71) Applicant: Viking Range LLC, Greenwood, MS (US)

(72) Inventors: Philip C. Carbone, North Reading, MA (US); David J. Hensel, Boston, MA (US); Warren J. Ellis, Worcester, MA (US); Jemsheer Thayyullathil, Greenwood, MS (US); Charles E. Marble, Brockton, MA (US)

(73) Assignee: VIKING RANGE LLC, Greenwood, MS (US)

( * ) Notice: Subject to any disclaimer, the term of this patent is extended or adjusted under 35 U.S.C. 154(b) by 0 days.

(21) Appl. No.: 16/430,014

(22) Filed: Jun. 3, 2019

(65) Prior Publication Data

US 2019/0368247 A1 Dec. 5, 2019

Related U.S. Application Data

(60) Provisional application No. 62/680,414, filed on Jun. 4, 2018.

(51) Int. Cl.
*E05D 3/16* (2006.01)
*E05D 11/00* (2006.01)
(Continued)

(52) U.S. Cl.
CPC ..... *E05D 3/16* (2013.01); *E05D 11/00* (2013.01); *E05D 11/06* (2013.01); *E05F 1/1207* (2013.01);
(Continued)

(58) Field of Classification Search
CPC ..... E05D 3/16; E05D 11/00; E05D 11/06; E05D 2003/166; E05D 3/14; E05F 1/1207;
(Continued)

(56) References Cited

U.S. PATENT DOCUMENTS 2,149,973 A * 3/1939 Ludwig ..... E05D 3/147 16/323
5,497,534 A 3/1996 Caruso
(Continued)

FOREIGN PATENT DOCUMENTS

CN 201627463 U 11/2010
CN 204081766 U 1/2015
(Continued)

OTHER PUBLICATIONS

Extended European Search Report (12 pages) dated Feb. 4, 2020 from corresponding European Application No. 19178118.6.
(Continued)

*Primary Examiner* — Jacob J Cigna
(74) *Attorney, Agent, or Firm* — Crowell & Moring LLP; John C. Freeman

(57) ABSTRACT

A hinge for a door of a storage unit and a method of repairing a storage unit that includes a pivotable door. The hinge including a first bracket and a second bracket. The hinge further including a linking mechanism for coupling the second bracket to the first bracket so that the second bracket is able to translate and rotate relative to the first bracket, wherein a maximum amount of rotation of the second bracket relative to the first bracket is not determined solely by operation of the linking mechanism.

12 Claims, 20 Drawing Sheets

(51) Int. Cl.
*E05D 11/06* (2006.01)
*E05F 1/12* (2006.01)
*F25D 23/02* (2006.01)

(52) U.S. Cl.
CPC ..... *F25D 23/028* (2013.01); *E05D 2003/166* (2013.01); *E05Y 2201/224* (2013.01); *E05Y 2201/484* (2013.01); *E05Y 2201/492* (2013.01); *E05Y 2800/40* (2013.01); *E05Y 2800/674* (2013.01); *E05Y 2900/31* (2013.01)

(58) Field of Classification Search
CPC .. F25D 23/028; F25D 2323/024; F25D 23/10; E05Y 2201/224; E05Y 2201/484; E05Y 2201/492; E05Y 2800/40; E05Y 2800/674; E05Y 2900/31; E05Y 2600/41; E05Y 2201/626; E05Y 2800/684; E05Y 2900/302; E04D 3/14–3/147
See application file for complete search history.

(56) References Cited

U.S. PATENT DOCUMENTS

| | | | | |
|---|---|---|---|---|
| 7,500,287 | B2 | 3/2009 | Brüstle | |
| 7,810,213 | B2 | 10/2010 | Brüstle | |
| 2007/0124893 | A1 | 6/2007 | Brüstle | |
| 2007/0209159 | A1* | 9/2007 | Salice | E05D 3/142 16/277 |
| 2008/0016651 | A1* | 1/2008 | Marsh | E05D 11/06 16/361 |
| 2008/0276425 | A1 | 11/2008 | Gherardi et al. | |
| 2009/0064457 | A1 | 3/2009 | Brüstle | |
| 2010/0269293 | A1 | 10/2010 | Wisniewski | |
| 2013/0212835 | A1 | 8/2013 | Lanzani | |
| 2013/0221825 | A1 | 8/2013 | Bonomie et al. | |
| 2018/0195328 | A1 | 7/2018 | Gorenbacher | |

FOREIGN PATENT DOCUMENTS

| | | | | |
|---|---|---|---|---|
| CN | 105588398 | A | 5/2016 | |
| DE | 10152699 | A1 * | 4/2003 | E05F 1/1284 |
| DE | 10 2010 045 187 | A1 | 1/2012 | |
| DE | 10 2017 100 270 | B3 | 1/2018 | |
| EP | 1 403 132 | A2 | 3/2004 | |
| FR | 2057278 | A5 | 5/1971 | |

OTHER PUBLICATIONS

International Search Report dated Oct. 8, 2019 (4 pages) from related PCT Application PCT/US2019/035135 filed Jun. 3, 2019.
Written Opinion dated Oct. 8, 2019 (8 pages) from related PCT Application PCT/US2019/035135 filed Jun. 3, 2019.
First Office Action dated Feb. 25, 2022 (13 pages) from related Chinese patent application 201980001029.2.

* cited by examiner

DOOR HINGE AND STORAGE UNIT INCLUDING SUCH A DOOR HINGE

This application claims the benefit of priority under 35 U.S.C. § 119(e)(1) of U.S. Provisional Application Ser. No. 62/680,414, filed Jun. 4, 2018, the entire contents of which are incorporated herein by reference.

FIELD OF THE INVENTION

The present invention is directed to a door hinge and a storage unit, such as a refrigerator, that includes such a door hinge.

BACKGROUND OF THE INVENTION

A common goal in kitchens is to have storage units blend in with each other as much as possible. In the case of a storage unit being a kitchen appliance, such as a refrigerator, there are a number of possible modes for installation into a kitchen setting. One mode is to install a built-in refrigerator. When the cabinetry is constructed, a housing/space is defined that allows a refrigerator to be moved into the housing/space. The housing/space is dimensioned such that the sides of the refrigerator sit flush with the cabinetry that defines the housing/space. The top portion of the front of the refrigerator has vents that allows the compressor to vent therethrough. The exterior of the door of the refrigerator that faces into the kitchen area is not paneled so as to match the panel design of the cabinetry. In a closed position, the door is not flush with the adjacent cabinetry and extends past the cabinetry toward the interior of the kitchen.

A second mode of installation of a refrigerator is the installation of an overlay refrigerator. An overlay refrigerator is a built-in refrigerator wherein the exterior of the door facing the interior of the kitchen is designed to be fitted with a panel to match the cabinet design. With the panel attached and the door in the closed position, the front of the door facing into the interior of the kitchen protrudes past the cabinetry toward the interior of the kitchen.

A third mode of installation of a refrigerator is the installation of an integrated refrigerator. An integrated refrigerator is a built-in refrigerator wherein when installed within the space/housing defined by the cabinetry, the refrigerator looks identical to the cabinetry. In other words, the refrigerator is camouflaged so that it not obvious where the refrigerator is located when the door of the refrigerator is closed. To help accomplish the camouflaged effect, the integrated refrigerator does not have compressor vents that are visible and it has an inset door that matches the pattern of the cabinetry. Furthermore, when the door is closed, it is flush with the adjacent cabinetry.

In the case of an integrated refrigerator, it is a requirement that the hinge of the door operates so that the door opens outward from the refrigerator cabinet. This requires that the door must pivot and the hinge positions the door such that the door remains clear of the adjacent cabinetry. This is schematically shown in FIG. 1, wherein the door 10 has been rotated by an angle θ with respect to the front edge 12 of the refrigerator 14 to an open position. In addition, a side edge 16 of the door 10 can be positioned past the front edge 12 so as to be spaced from the adjacent cabinetry 18.

Issues that may occur with integrated refrigerators are that the angle θ may be mechanically limited by the internal structure of the hinge used. In addition, the hinge may pitch a portion of the door 10 inward into the interior of the refrigerator cabinet. The possibility of having the door 10 positioned within the interior of the refrigerator 14 means that accommodations must be made within the interior so as to accept entrance of the portion of the door 10. Such accommodations entail removing storage capacity, such as in the form of shelving or drawers, in the area where the door 10 would enter into the interior of the refrigerator 14.

It is an object of the present invention to increase the amount of space within the interior of an integrated refrigerator.

Another object of the present invention is to increase the angular range of a hinge used for an integrated refrigerator.

SUMMARY OF THE INVENTION

One aspect of the present invention regards a hinge for a door of a storage unit, the hinge including a first bracket and a second bracket. The hinge further including a linking mechanism for coupling the second bracket to the first bracket so that the second bracket is able to translate and rotate relative to the first bracket, wherein a maximum amount of rotation of the second bracket relative to the first bracket is not determined solely by operation of the linking mechanism.

A second aspect of the present invention regards a storage unit including a housing that defines a cavity into which items can be stored, wherein the cavity has an opening. The storage unit further including a door that moves from a first position that blocks access to the opening and the cavity to a second position that allows access to the cavity via the opening. A hinge is attached to the housing and the door, wherein the hinge includes a first bracket attached to the housing and a second bracket attached to the door. The hinge further including a linking mechanism for coupling the second bracket to the first bracket so that the second bracket is able to translate and rotate relative to the first bracket, wherein a maximum amount of rotation of the second bracket relative to the first bracket is not determined solely by operation of the linking mechanism.

A third aspect of the present invention regards a storage system that includes a first storage unit that has a first housing that includes a first vertical side and wherein the first housing defines a first cavity into which first items can be stored, wherein the first cavity has a first opening. The first storage unit further includes a first door that moves from a first position that blocks access to the first opening and the first cavity to a second position that allows access to the first cavity via the first opening. The storage system includes a second storage unit that is adjacent to the first storage unit, wherein the second storage unit includes a second housing that has a second vertical side that is substantially parallel to and adjacent to the first vertical side. The second housing defines a second cavity into which second items can be stored, wherein the second cavity has a second opening. The second storage system includes a second door that moves from a third position that blocks access to the second opening and the second cavity to a fourth position that allows access to the second cavity via the second opening. The second storage unit also includes a hinge attached to the second housing and the second door, wherein the hinge includes a first bracket attached to the second housing and a second bracket attached to the second door and a linking mechanism for coupling the second bracket to the first bracket. The coupling is such that the second bracket is able to translate and rotate relative to the first bracket, wherein a maximum amount of rotation of the second bracket relative to the first bracket is not determined solely by operation of the linking mechanism.

A fourth aspect of the present invention regards a method of repairing a storage unit that includes a pivotable door. The method includes using a first element to aid in pivoting the door to a position, wherein the first element has a predetermined threshold of stress such that when the first element encounters a stress above the predetermined threshold of stress there will be a visible indication thereof. The method further includes observing that the visible indication has occurred, which is an indication that the door has encountered an overload situation. The method also includes replacing the first element with a second element that is identical to the first element, which also has the predetermined threshold of stress such that when the second element encounters a stress above the predetermined threshold of stress there will be a visible indication thereof.

A fifth aspect of the present invention regards a hinge for a door of a storage unit, wherein the hinge includes a first bracket, a second bracket, and a linking mechanism for coupling the second bracket to the first bracket so that the second bracket is able to translate and rotate relative to the first bracket. The hinge further includes an adjustable biasing mechanism that is coupled to the linking mechanism and which adjusts a load applied to the linking mechanism so as to move the first bracket in a particular direction.

A sixth aspect of the present invention regards a storage unit that includes a housing that defines a cavity into which items can be stored, wherein the cavity has an opening. The storage unit includes a door that moves from a first position that blocks access to the opening and the cavity to a second position that allows access to the cavity via the opening. The storage unit further includes a hinge attached to the housing and the door. The hinge includes a first bracket attached to the housing, a second bracket attached to the door, and a linking mechanism for coupling the second bracket to the first bracket so that the second bracket is able to translate and rotate relative to the first bracket. The hinge further includes an adjustable biasing mechanism that is coupled to the linking mechanism and which adjusts a load applied to the linking mechanism so as to bias the door toward the housing.

A seventh aspect of the present invention regards a storage system that includes a first storage unit that includes a first vertical side and wherein the first housing defines a first cavity into which first items can be stored, wherein the first cavity has a first opening. The first storage unit includes a first door that moves from a first position that blocks access to the first opening and the first cavity to a second position that allows access to the first cavity via the first opening. The storage system also includes a second storage unit that is adjacent to the first storage unit, where the second storage unit includes a second housing that has a second vertical side that is substantially parallel to and adjacent to the first vertical side, the second housing defines a second cavity into which second items can be stored, wherein the second cavity has a second opening. The second storage includes a second door that moves from a third position that blocks access to the second opening and the second cavity to a fourth position that allows access to the second cavity via the second opening. A hinge is attached to the second housing and the second door, the hinge including a first bracket attached to the second housing and a second bracket attached to the second door. The hinge further includes a linking mechanism for coupling the second bracket to the first bracket so that the second bracket is able to translate and rotate relative to the first bracket. The hinge also includes an adjustable biasing mechanism that is coupled to the linking mechanism and which adjusts a load applied to the linking mechanism so as to bias the second door toward the second housing.

One or more aspects of the present invention provide the advantage of increasing the amount of space within the interior of a storage unit, such as an integrated refrigerator.

One or more aspects of the present invention provide the advantage of increasing the angular range of a hinge used for a door of a storage unit, such as an integrated refrigerator.

BRIEF DESCRIPTION OF THE DRAWINGS

The various features, advantages and other uses of the present apparatus will become more apparent by referring to the following detailed description and drawing in which.

DETAILED DESCRIPTION

As shown in the exemplary drawing figures, an embodiment of an integrated refrigerator is shown, wherein like elements are denoted by like numerals.

Figure 1:
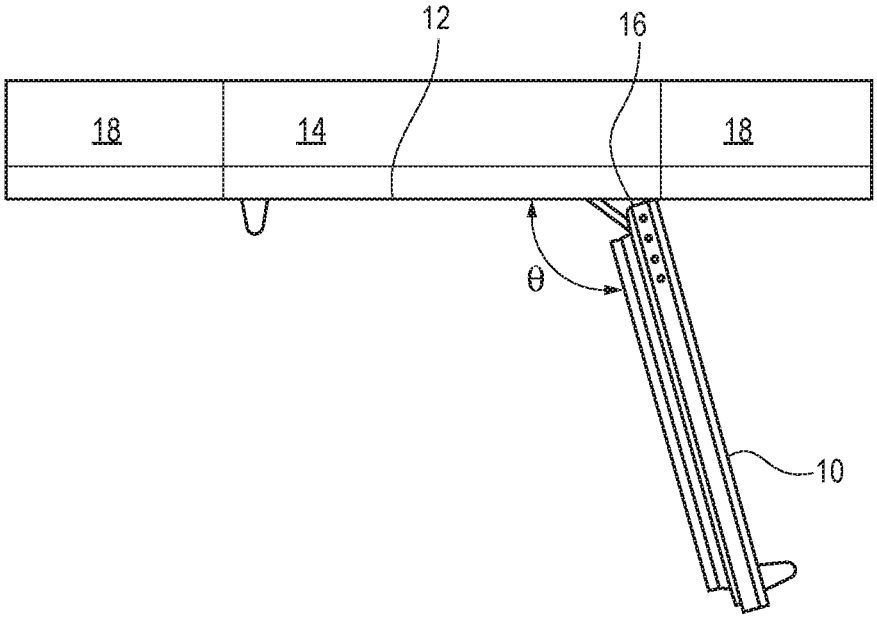
FIG. 1 is a top view of a known orientation of a door of a refrigerator with respect to adjacent cabinetry, showing the door in an open position.
Figure 2:
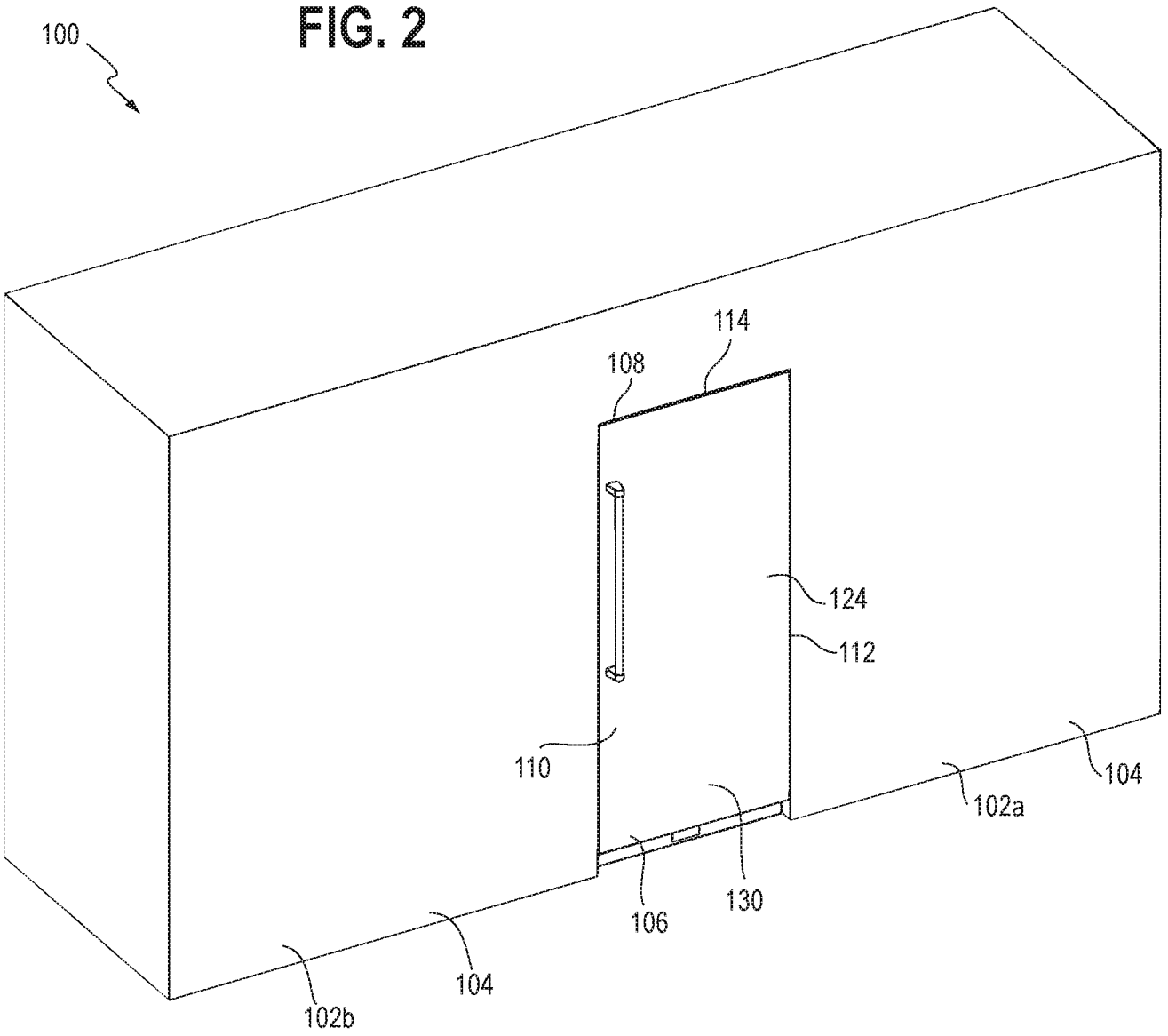
FIG. 2 is a perspective view of an embodiment of a storage system that includes an embodiment of a refrigerator in accordance with the present invention.

FIG. 2 shows an embodiment of a storage system 100 that is installed in a kitchen of a residence. The storage system 100 includes multiple storage units 102*a-b*. Each storage unit 102*a-b* has a housing (not shown) that defines a cavity with an opening that faces the interior of the kitchen. Examples of such storage units 102*a-b* are known cabinetry, wherein the structure of the housing can vary from storage unit to storage unit depending on its position and the particular items which are to be stored within the cabinetry. For example, each opening can include different configurations of drawers and/or shelves for storage of various items. One or more of the storage units 102*a-b* includes a door 104 that is attached to the corresponding housing, wherein the door 104 moves from a first position that blocks access to the opening to a second position that allows access to the opening and cavity associated with the storage unit.

The storage system 100 is an integrated storage system in that when the doors 104 are in the closed position, they are flush with each other so that doors blend with each other.

Figure 3:
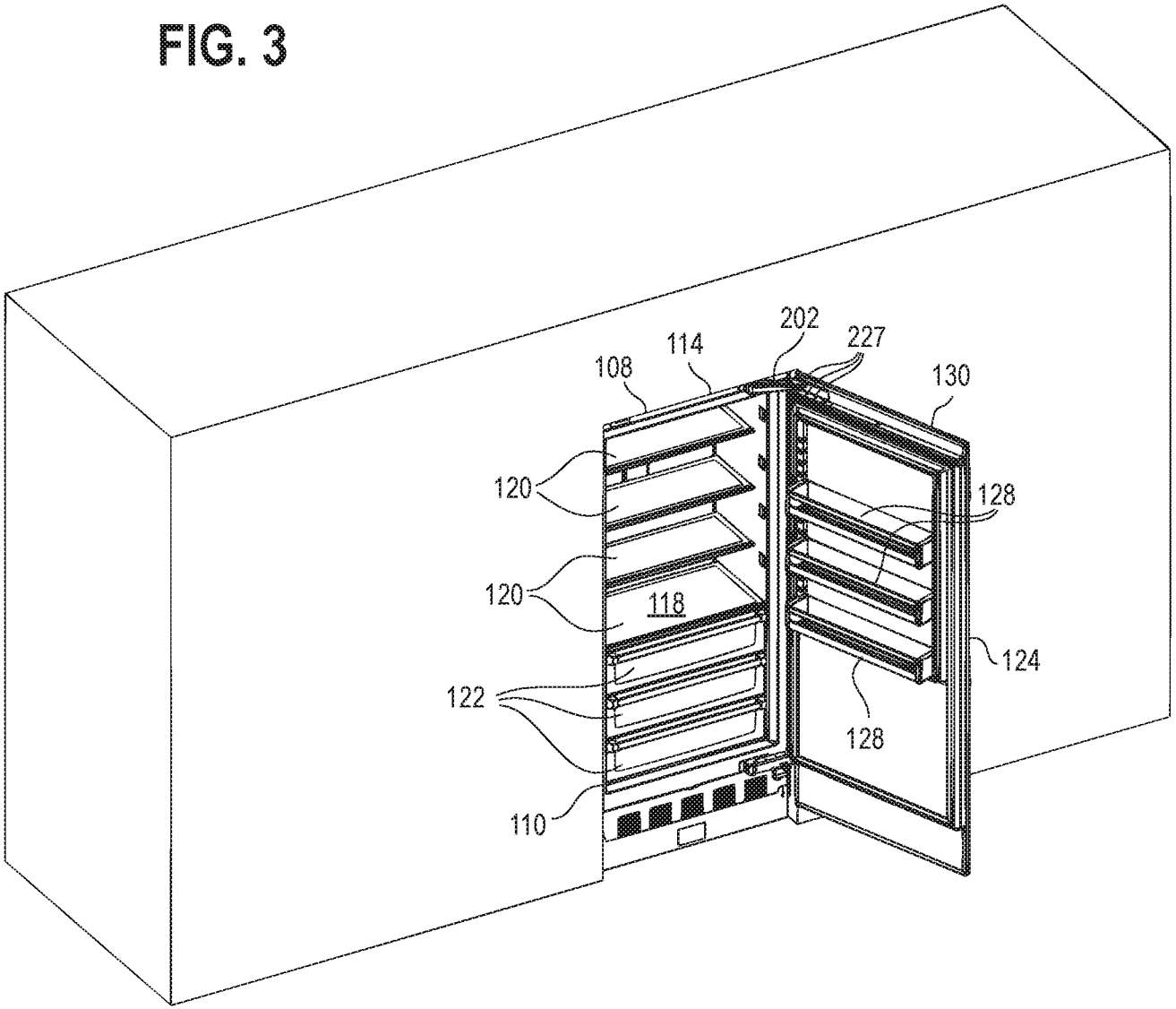
FIG. 3 is a perspective view of the refrigerator of FIG. 2 when the door is in an open position in accordance with the present invention.

One of the storage units of the storage system 100 is an integrated refrigerator 106. As shown in FIGS. 2-3, the refrigerator 106 has a housing 108 that is positioned between two other storage units 102*a* and 102*b*. The housing 108 includes a left vertical side 110, a right vertical side 112 and a top 114 that is integrally attached to the sides 110 and 112. An interior liner 116 is attached within the housing 108 and defines a cavity 118 that includes several shelves 120 and drawers 122.

The refrigerator 106 includes an inset door 124 that is attached to the housing 108 in a manner to be described hereinafter. As shown in FIG. 3, an interior side 126 of the door 124 includes shelving 128. The door 124 further includes an exterior side 130 that matches the pattern of the exterior sides of the doors 104 of the other storage units 102*a* and 102*b*.

A pair of hinges 200 and 202 are attached to the top and bottom left or right corners of the door 124 and the housing 108. For the sake of brevity, the top hinge 202 to be attached to the top right corners of the door 124 and housing 108 will be discussed hereafter with the understanding that the bottom hinge 200 to be attached to the bottom right corners of the door 124 and housing has a similar structure, attachment scheme, and operation as will be explained later. Note that the directional terms "right" and "left" used throughout this description are defined with respect to an observer that is facing the exterior side 130 of the door 124 when the door 124 is in a closed position. Also, note that in the case where the hinges 200 and 202 are to be attached to the top and bottom left corners of the door 124 and housing 108, the hinge 202 is attached to the top corners and the hinge 200 is attached to the bottom corners in a manner similar to that described below.

Figure 4A:
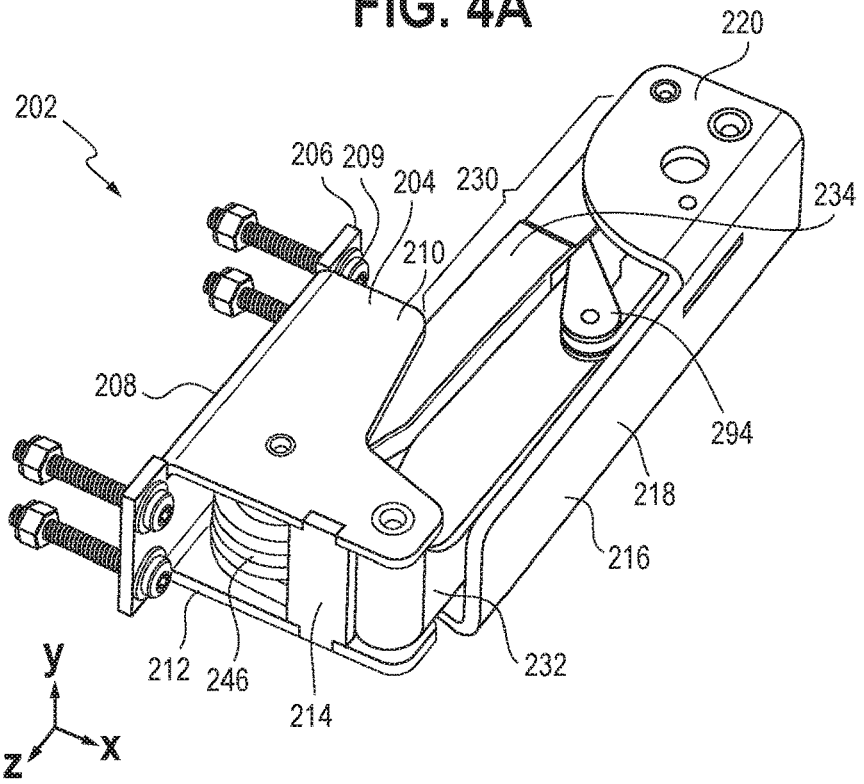
FIG. 4A is a top perspective view of an embodiment of a hinge in a retracted position to be used with the refrigerator of FIGS. 2-3 in accordance with the present invention.
Figure 4B:
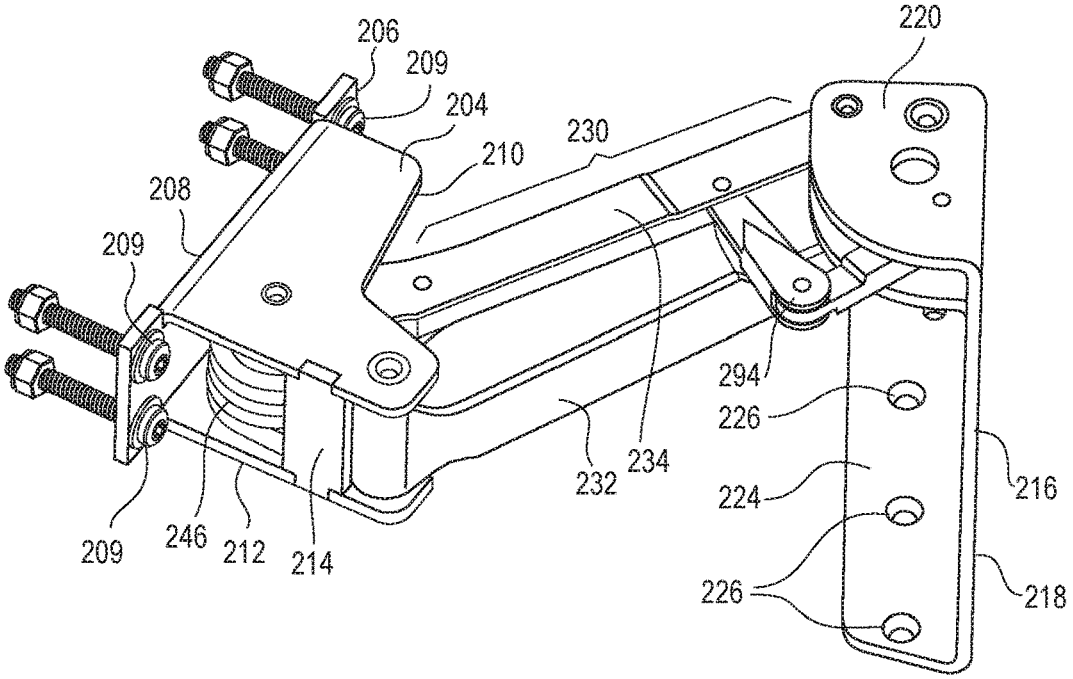
FIGS. 4B-D show possible orientations of the hinge of FIG. 4A as the hinge moves toward a fully opened position.
Figure 4C:
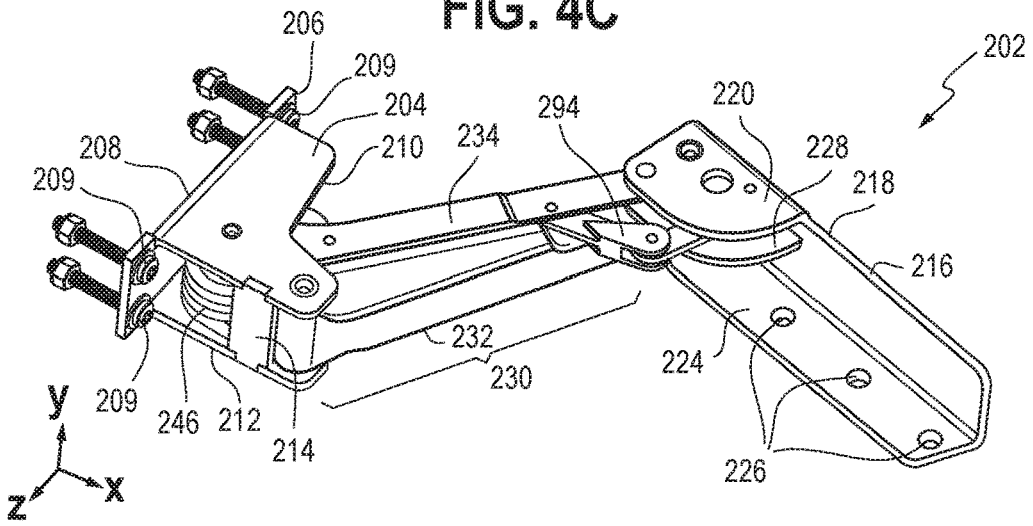
Figure 4D:
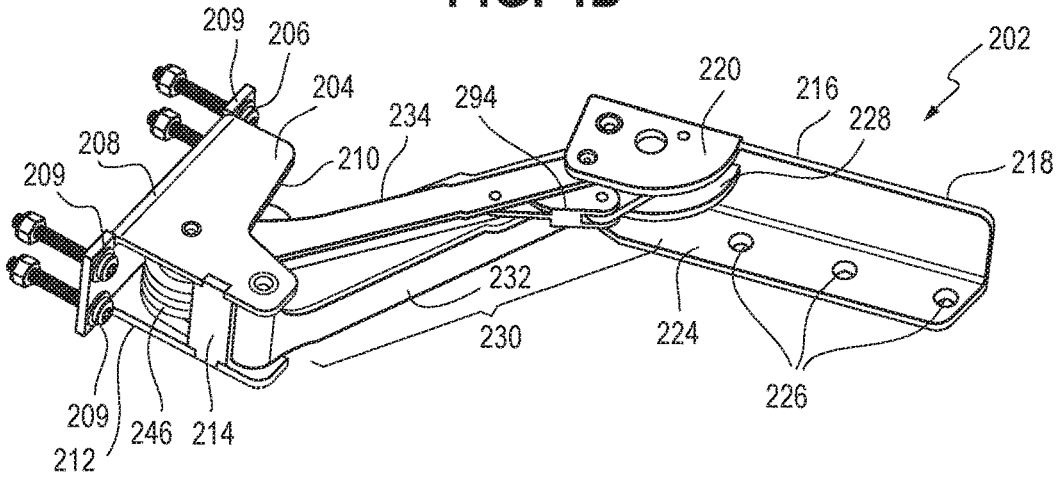
Figure 4E:
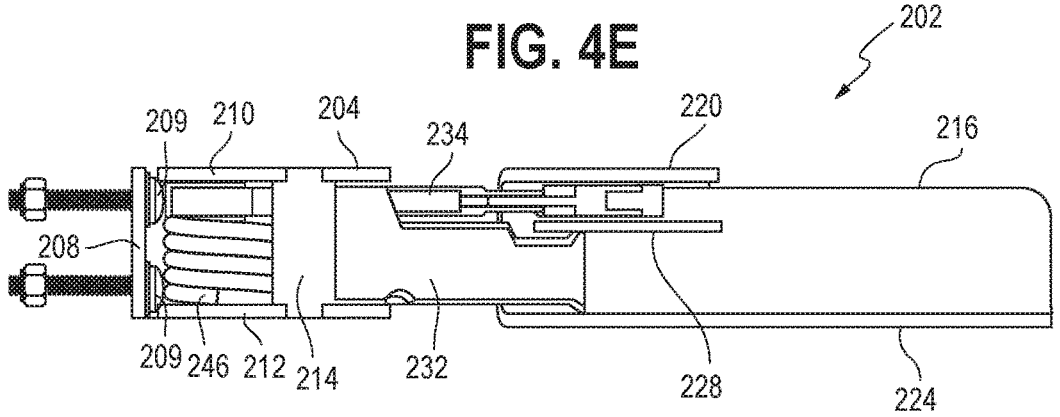
FIG. 4E shows a front view of the hinge of FIG. 4A when oriented at the position shown in FIG. 4D.
Figure 5:
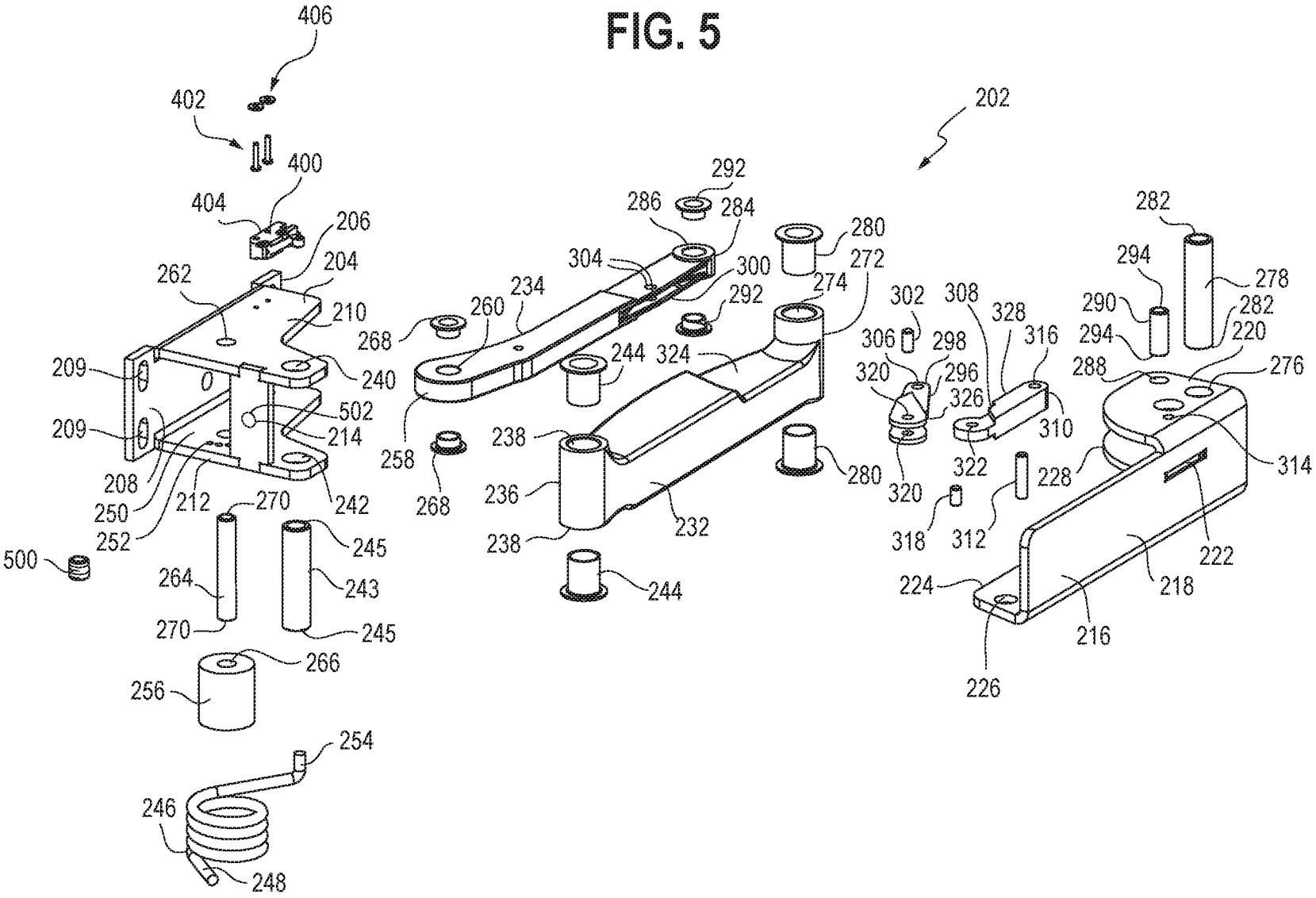
FIG. 5 shows a perspective, exploded view of the hinge of FIG. 4A.
Figure 6A:
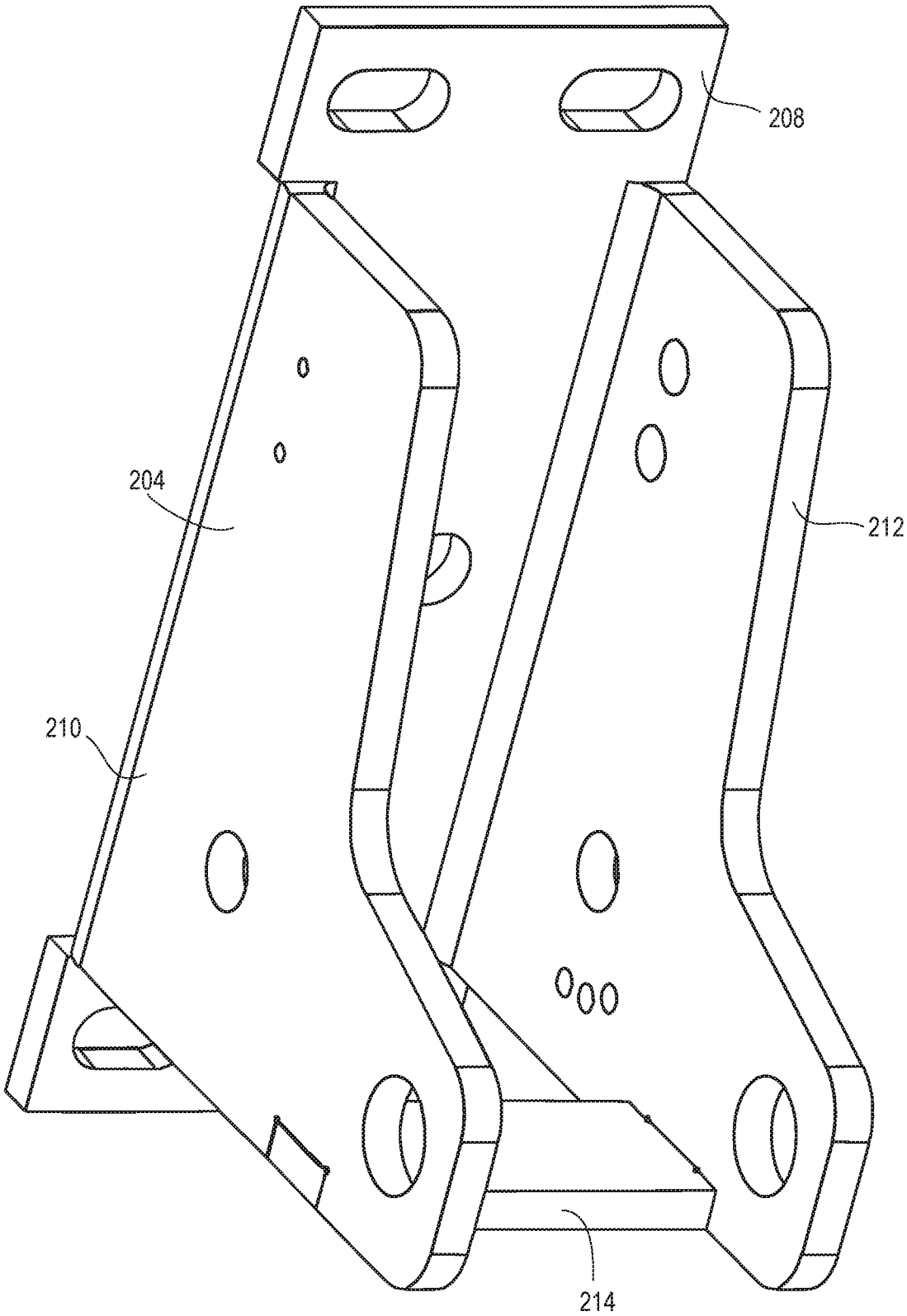
FIG. 6A shows a top, perspective view of an embodiment of a support bracket to be used with the hinge of FIGS. 4A-E in accordance with the present invention.
Figure 6B:
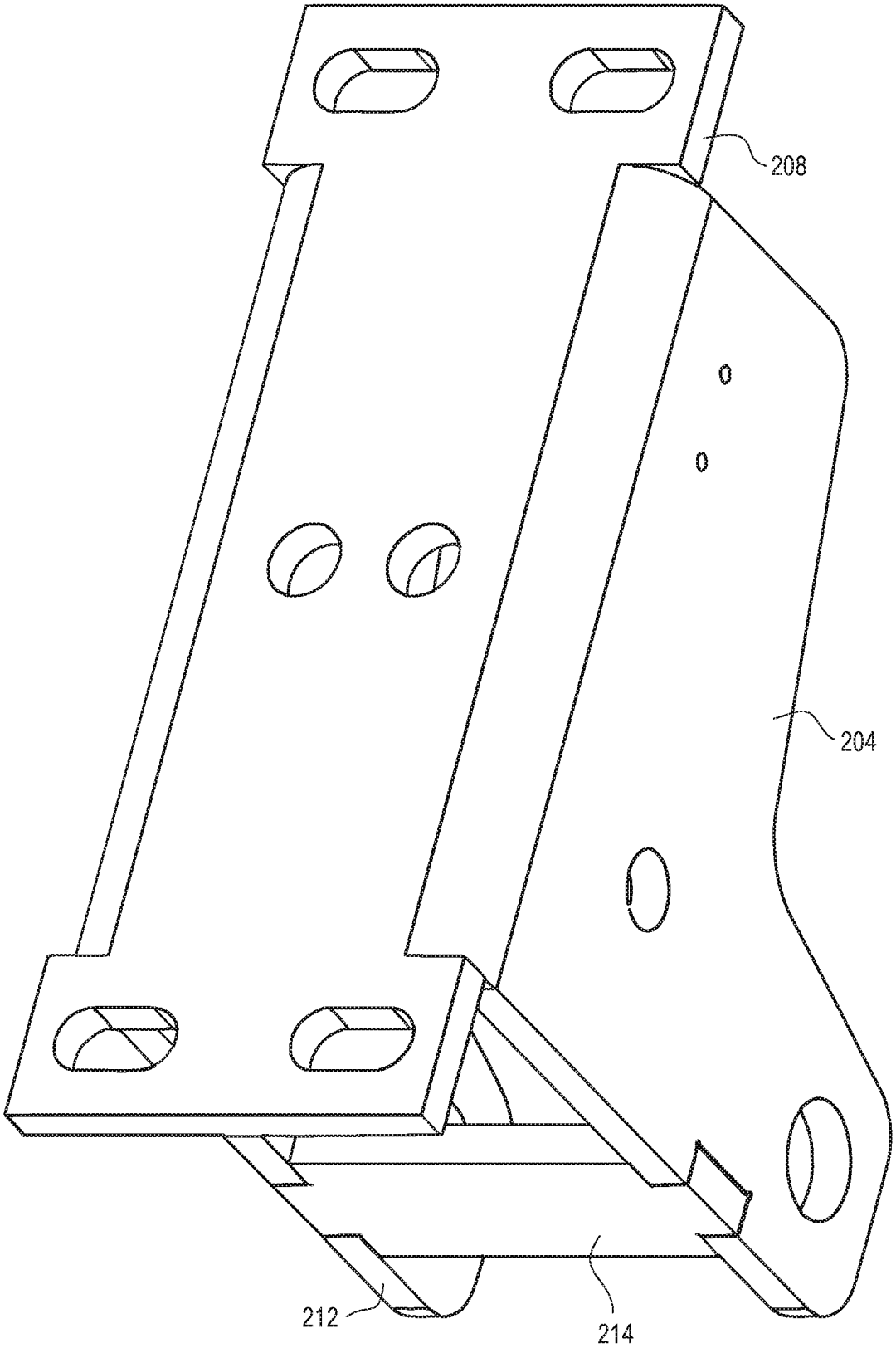
FIG. 6B shows a bottom, perspective view of the support bracket of FIG. 6A.
Figure 7A:
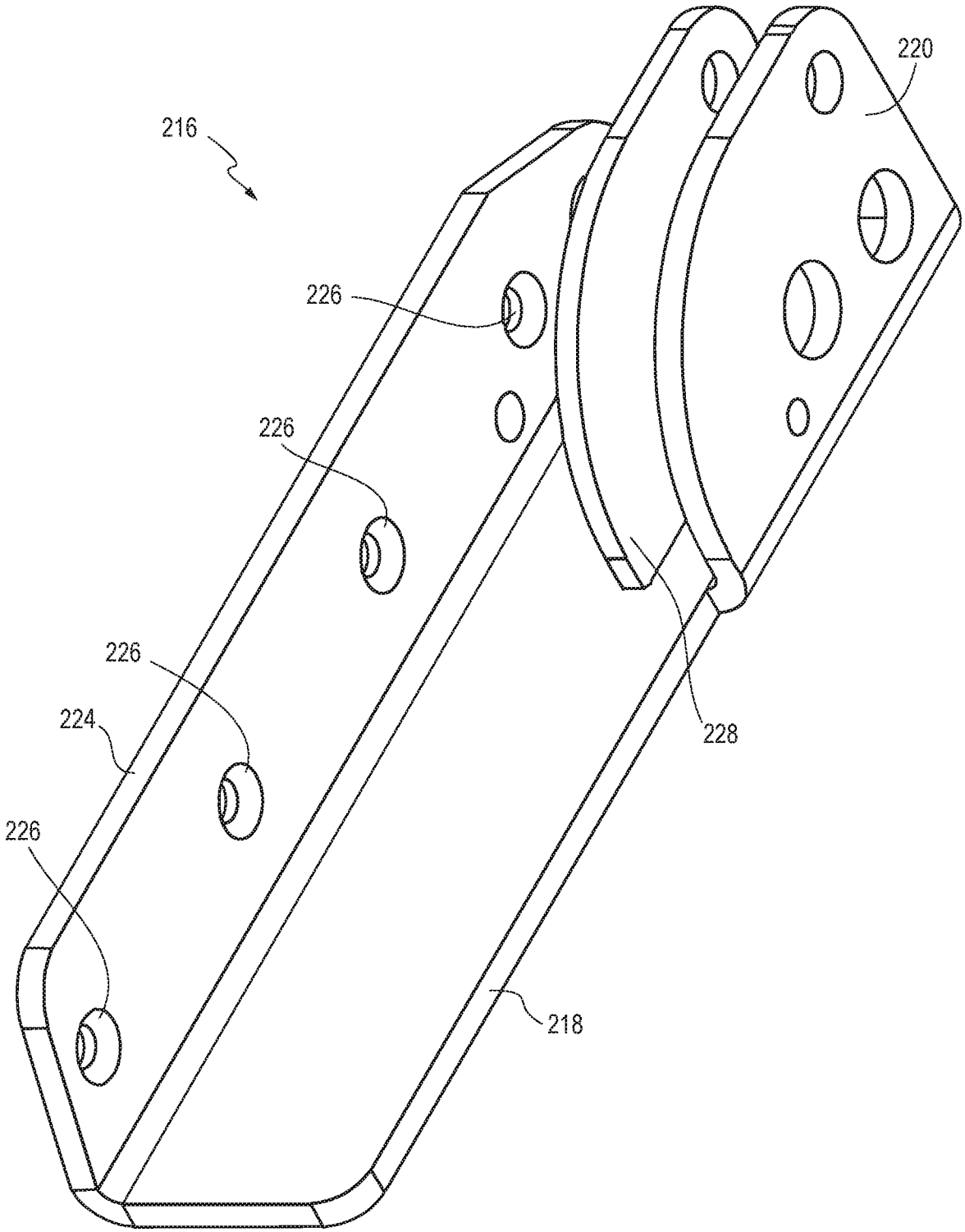
FIG. 7A shows a top, right, perspective view of an embodiment of a support bracket to be used with the hinge of FIGS. 4A-E in accordance with the present invention.
Figure 7B:
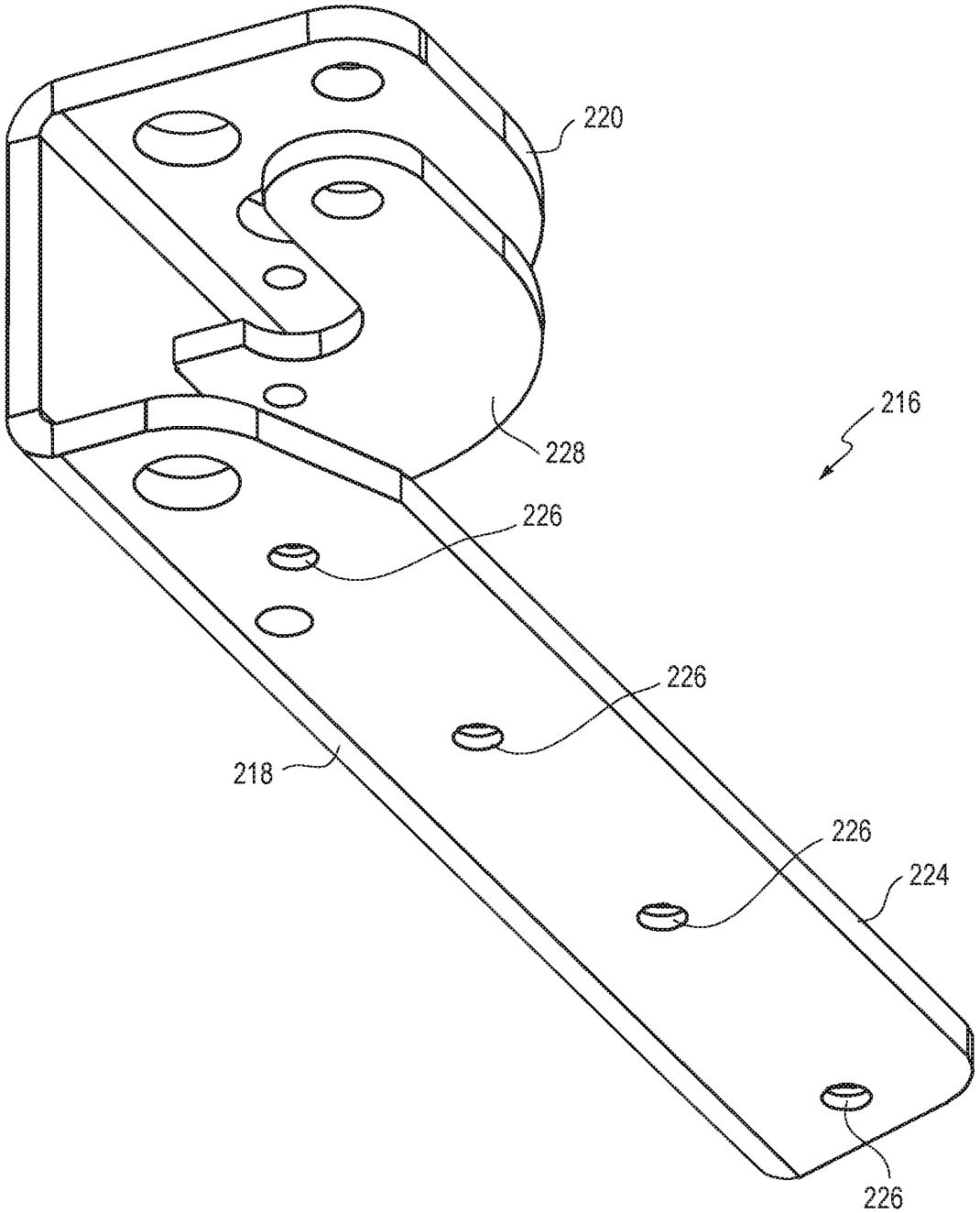
FIG. 7B shows a top, left, perspective view of the support bracket of FIG. 7A.

FIGS. 4A-E, 5, 6A-B and 7A-B show an embodiment of the top hinge 202. The top hinge 202 includes a support bracket 204 that is attached to a top portion of the housing 108 so that a right edge 206 of an I-shaped bottom plate 208 is positioned approximately 3.85 inches from the right vertical wall 112 of the housing 108. At each of the left and right edges of the bottom plate 208 are a pair of openings 209. The support bracket 204 is made of a durable material, such as steel. As shown in FIGS. 5 and 6A-B, a pair of identical L-shaped side pieces 210, 212 are positioned within notches formed in the side of the bottom plate 208 and attached to the bottom plate 208 in a well-known manner, such as welding. Alternatively, the bottom plate 208 and the side pieces 210, 212 can be formed from the same piece of material. To provide further strengthening, a cross-piece 214 is positioned within notches formed in the right ends of the side pieces 210, 212 and attached to the side pieces 210, 212 in a well-known manner, such as welding.

As shown in FIGS. 4A-E, 5 and 7A-B, the top hinge 202 includes a mounting bracket 216. The mounting bracket 216 is made of a durable material that is the same used for the support bracket 204. Mounting bracket 216 has a rectangular-like exterior face 218 with an arcuate ear 220 integrally attached at an angle of approximately 90 degrees. The exterior face 218 defines a slot 222. Also integrally formed with the exterior face 218 is a mounting face 224 that faces toward the floor when the hinge 202 is attached to the door 124. The mounting face 224 is at an angle of approximately 90 degrees relative to the exterior face 218 and has multiple holes 226. The mounting bracket 216 is attached to a top rectangular-like horizontal area at the top, right corner of the inner side 126 of the door 124 that extends from the right edge of the door 124 by approximately seven inches. Attachment is achieved by aligning the mounting face 224 onto the bottom rectangular-like area and attaching the mounting bracket 216 thereto by having bolts 227 inserted through the holes 226 and engage aligned threaded openings (not shown) formed in the top rectangular-like horizontal area.

As shown in FIGS. 4A-E, 5 and 7A-B, the mounting bracket 216 has an interior flange 228 integrally attached to the exterior face 218 that is opposite to, parallel to, and has a shape that is almost identical to that of arcuate ear 220. Attachment is achieved by inserting a bottom portion of the interior flange 228 into slot 222 formed in the exterior face 218 and then welding the interior flange 228 to the exterior face 218. As shown in FIG. 4E, the flange 228 is positioned closer to the arcuate ear 220 than the mounting face 224.

As shown in FIGS. 4A-E and 5, the mounting bracket 216 is coupled to the support bracket 204 by a linking mechanism 230. The coupling is such that the mounting bracket 216 is able to translate and rotate relative to the support bracket 204, wherein a maximum amount of rotation of the mounting bracket 216 relative to the support bracket 204 is not determined solely by operation of the linking mechanism 230.

As shown in FIGS. 4A-E and 5, the linking mechanism 230 includes a load bearing arm 232 and a return arm 234. In the case of the load bearing arm 232, a cylindrical-like end 236 is positioned between the side pieces 210, 212 of the support bracket 204 so that the openings 238 at each end of the end 236 are aligned with the openings 240, 242 of the side pieces 210, 212. Note that each of the openings 238 includes a bushing 244 press-fit into the opening 238. Next, a solid metal pin 243 is inserted through the aligned bushings 244 and openings 240, 242 and 238 so that the pin 243 is positioned therein and attached to the load bearing arm 232. Note that pin 243 is attached, because ends 245 of pin 243 expand and form a permanent compressive fit with the bushings 244. While pin 243 is permanently attached to the bushings 244 and the end 236, ends of the pin 243 are positioned within openings 240 and 242 so that the load bearing arm 232 is able to freely rotate about the pin 243 and an axis defined along the longitudinal axis of opening 238.

Attachment of the return arm 234 to the support bracket 204 will now be described. The return arm 234 is coupled to a biasing mechanism that includes a helical spring 246 that biases the return arm 234 so that it tends to move mounting bracket 216 and the door 124 in a return direction to the closed position shown in FIG. 4A.

Figure 8:
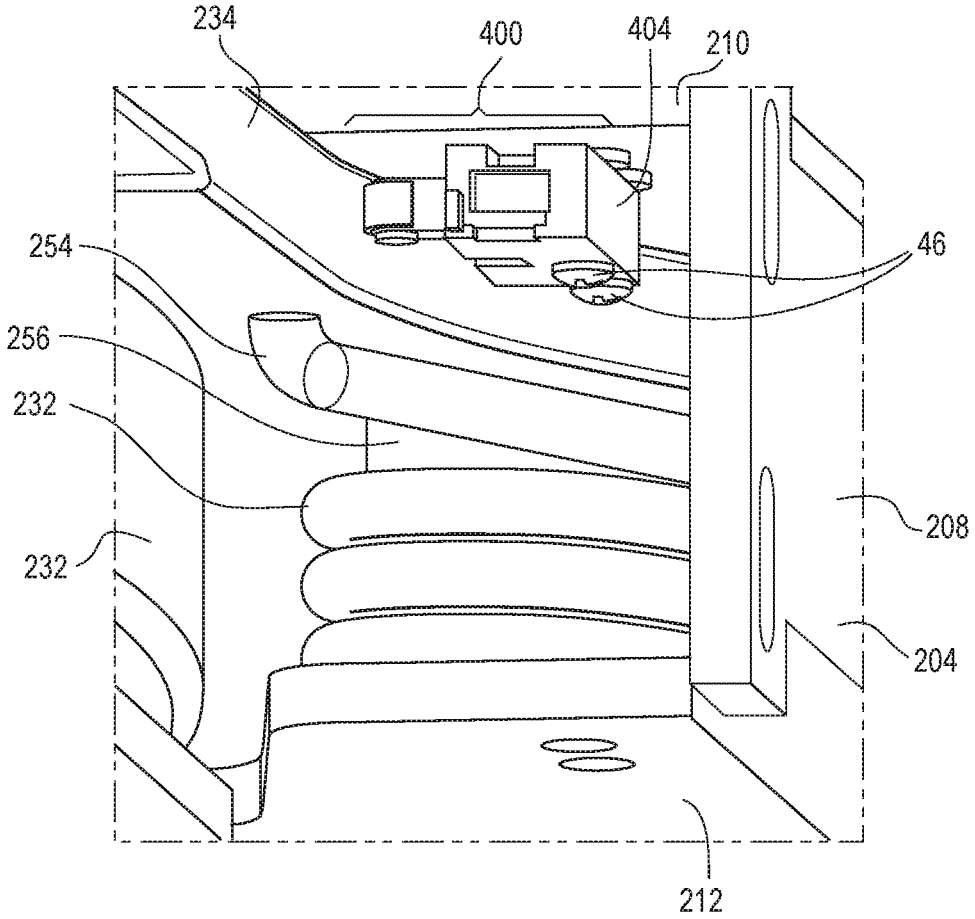
FIG. 8 shows an enlarged, interior view of an embodiment of a support bracket of the hinge shown in FIGS. 4A-E, 5, 6A-B, and 7A-B in accordance with the present invention.

As shown in FIGS. 5, 8 and 9A-B, a free end 248 of the helical spring 246 is supported on the interior surface 250 of the side piece 212 and abuts the interior surface of the cross-piece 214. The preload force of the spring 246 holds the free end 248 against the cross-piece 214. The longitudinal axis of the helical spring 246 is aligned with an opening 252 of the side piece 212. The other free end 254 of the spring 246 is inserted into a hole formed in the underside of the return arm 234 so as to be attached to the return arm 234 as shown in FIG. 8. When the helical spring 246 is in place, a spacing cylinder 256 is placed within the opening defined by the spring 246 as shown in FIG. 8.

Figure 9A:
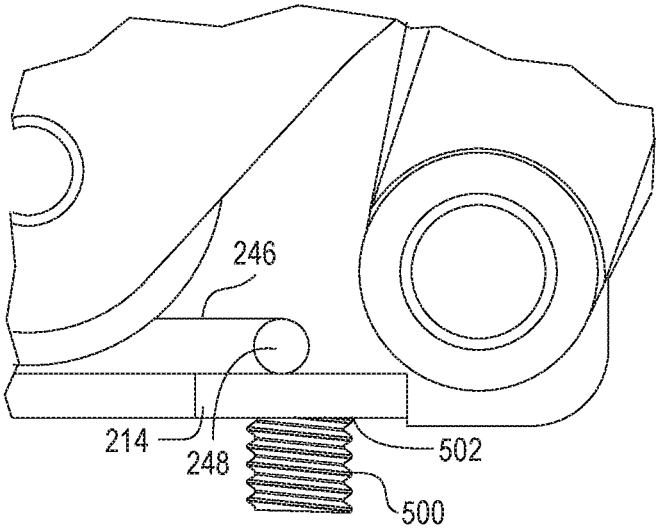
FIG. 9A shows an embodiment of a bias adjustment mechanism at a first orientation to be used with the support bracket of FIGS. 6A-6B in accordance with the present invention.
Figure 9B:
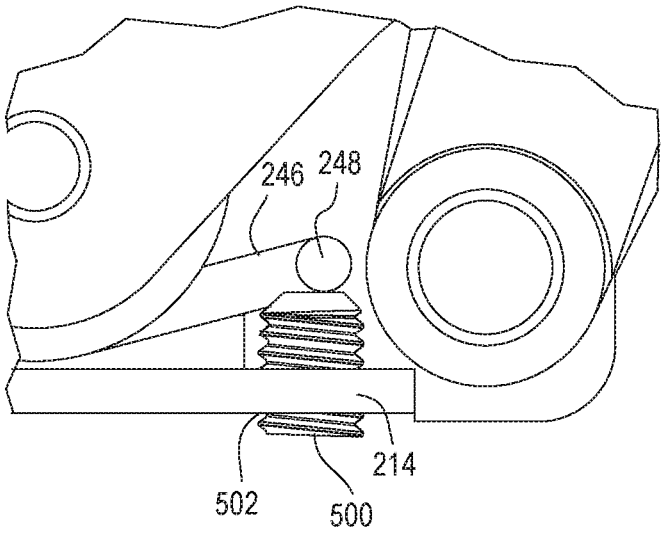
FIG. 9B shows the bias adjustment mechanism of FIG. 9A at a second orientation.

As shown in FIGS. 9A-B, the load supplied by the spring 246 to the return arm 234 can be adjusted. As shown in FIG. 9A, the previously mentioned biasing mechanism includes a screw 500 that is inserted into a threaded opening 502 of the cross-piece 214. To adjust the load supplied by the spring 246, the screw 500 is rotated so that it extends through the opening 502, engages the free end 248 of the helical spring 246, and moves the free end 248 to a desired position spaced from the cross-piece 214. Such movement adjusts the amount of compression of the spring 246 and so the amount of load generated by the spring 246 is adjusted. Moving the free end 248 further away from the cross-piece 214 via screw 500 will lead to an increase in the load supplied by the spring 246. Moving the free end 248 closer to the cross-piece 214 via screw will lead to a decrease in the load supplied by the spring 246.

With the spacing cylinder 256 in position, an end 258 of the return arm 234 is positioned between the top surface of the cylinder 256 and the side piece 210 of the support bracket 204. Within both ends of opening 260 of the end 258 are bushings 268 that are press-fit into the opening 260. As a result of the positioning of the return arm 234, the opening 260 of the end 258 and the openings of the attached bushings 268 are aligned with the opening 262 of the side piece 210. Next, a metal pin 264 is inserted through the openings 262, 260, the openings of the bushings 268, a cylindrical opening 266 of the cylinder 256 and the opening 252 of the side piece 212 so that the pin 264 is positioned therein and attached to the return arm 234. Note that pin 264 is so attached, because ends 270 of pin 264 expand and form a permanent compressive fit with the bushings 268. While pin 264 is permanently attached to the bushings 268 and the end 258 of the return arm 234, ends of the pin 264 are positioned within the openings 252 and 262 so that the return arm 234 is able to freely rotate about the pin 264 and an axis defined along the longitudinal axis of opening 260.

Attachment of the load bearing arm 232 and the return arm 234 to the mounting bracket 216 will now be discussed. Regarding attachment of the load bearing arm 232 to the mounting bracket 216, the load bearing arm 232 has another cylindrical-like end 272 that is positioned between the interior flange 228 and the mounting face 224 of the mounting bracket 216 so that the opening 274 is aligned with the aligned openings (not shown) of the mounting face 224 and the interior flange 228 and an aligned opening 276 of the arcuate ear 220. Note that each of the openings 274 includes a bushing 280 press-fit into the opening 274. Next, a solid metal pin 278 is inserted through the aligned bushings 280 and openings 274, 276 and the aligned openings of the mounting face 224 and the interior flange 228 so that the pin 278 is positioned therein and attached to the load bearing arm 232. Note that pin 278 is so attached, because ends 282 of pin 278 expand and form a permanent compressive fit with the bushings 280. While pin 278 is permanently attached to the bushings 280 and the end 272 of the load bearing arm 232, ends 282 of the pin 278 are positioned within openings 276 and the aligned opening (not shown) of the mounting face 224 so that the load bearing arm 232 is able to freely rotate about the pin 278 and an axis defined along the longitudinal axis of the opening 274.

Regarding attachment of the return arm 234 to the mounting bracket 216, the return arm 234 has another end 284 that is positioned between the interior flange 228 and the arcuate ear 220 of the mounting bracket 216. Note that each of the openings 286 of the end 24 includes a bushing 292 press-fit into the opening 286. When the end 284 is positioned between interior flange 22 and arcuate ear 220, the opening 286 of the end 284 is aligned with the aligned opening (not shown) of the interior flange 228 and an aligned opening 288 of the arcuate ear 220. Next, a solid metal pin 290 is inserted through the aligned bushings 292, the openings 286, 288 and the aligned opening of the interior flange 228 so that the pin 290 is positioned therein and attached to the return arm 234. Note that pin 290 is so attached, because ends 294 of pin 290 expand and form a permanent compressive fit with the bushings 292. While pin 290 is permanently attached to the bushings 292 and the end 24 of the return arm 234, ends 294 of the pin 290 are positioned within openings 288 and the aligned opening (not shown) of the interior flange 228 so that the return arm 234 is able to freely rotate about the pin 290 and an axis defined along the longitudinal axis of the opening 286.

As described previously and shown in FIGS. 4A-E, the attached load bearing arm 232 and the return arm 234 define parallel paths of movement so that during any instant of time of operation of the linking mechanism 230, the load bearing arm 232 defines a first path of movement and the return arm 234 defines a second path of movement that does not intersect the first path of movement. Thus, the maximum angle of rotation between the mounting bracket 216 and the support bracket 204 is not determined by a direct interaction between the load bearing arm 232 and the return arm 234.

In order to limit the value of the maximum angle of rotation between the mounting bracket 216 and the support bracket 204, a stop mechanism 294 is employed that interacts with the linking mechanism so as to determine the maximum amount of rotation of the mounting bracket 216 relative to the support bracket 204. As shown in FIGS. 4A-E and 5, the stop mechanism 294 includes a lever 296 that has an end 298 that is inserted into a slot 300 formed in the return arm 234. The end 298 is rotatably attached to the return arm 234 by a pin 302 inserted into openings 304 of the return arm 234 and an opening 306 of the lever 296. A second lever 308 of the stop mechanism 294 that has an end 310 that is inserted into the space formed between the interior flange 228 and the arcuate ear 220. The end 310 is rotatably attached to the mounting bracket 216 by a pin 312 inserted into an opening 314 of arcuate ear 220 and an opening 316 of the lever 308. A pin 318 is inserted into aligned openings 320, 322 of the levers 296 and 308 so that the levers can rotate relative to one another.

Note that a portion of the stop mechanism 294 is positioned within an indentation 324 formed in the load bearing arm 232. In addition, the lever 296 has a stop surface 326 and the lever 310 has an engagement surface 328 which interact with one another when a maximum amount of rotation of said mounting bracket 216 relative to the support bracket 204 is achieved. For example, the maximum amount of rotation of the mounting bracket 216 relative to the loading bearing arm 232 can range from 0 to 130 degrees.

In addition, the maximum amount of rotation of the mounting bracket 204 relative to a plane containing bottom plate 208 of support hinge 204 when attached to the housing 108 of the refrigerator 106 can range from −0.5 to 110 degrees.

With the above description of the top hinge 202 to be attached to the top right corners of the door 124 and housing 108 in mind, the operation of bottom hinge 200 can be readily understood by the following discussion of the movement of the top hinge 202 when attached to the top right corners of the door 124 as shown in FIGS. 10A-E. Note that the bottom hinge 200 is essentially a mirror image of the top hinge 202 with respect to horizontal plane that bisects a vertical line drawn from the top hinge 202 to the bottom hinge 200. One difference between the top hinge 202 and the bottom hinge 200 is that the top hinge 202 can include a door switch 400 that indicates whether or not the door 124 is at an open or closed position. As shown in FIGS. 5 and 6, the door switch 400 is attached to the side piece 210 by having screws 402 inserted through washers 406 and engage aligned openings of a housing 404 of the switch 400 and the side piece 210. As shown in FIG. 8, a roller lever 404 of the switch 400 extends toward and contacts the return arm 234. At the closed position of the door 124, the return arm roller lever 404 makes contact with a side wall of the return arm 234, which causes a circuit 504 to be opened as shown in FIG. 11B. The opening of the circuit 504 will alert a controller (not shown) that the door is closed and results in various systems controlled by the controller to be either operated or stopped. When the door is positioned away from the closed position of FIG. 11B, the roller lever 404 will no longer contact the return arm 234, which results in the circuit 504 being closed as shown in FIG. 11A. The closing of the circuit alerts the controller that the door is opened and results in various systems controlled by the controller to be either operated or stopped. In the movement to be described with respect to the top hinge 202, the bottom hinge 200 will simultaneously mirror such movement.

Figure 10A:
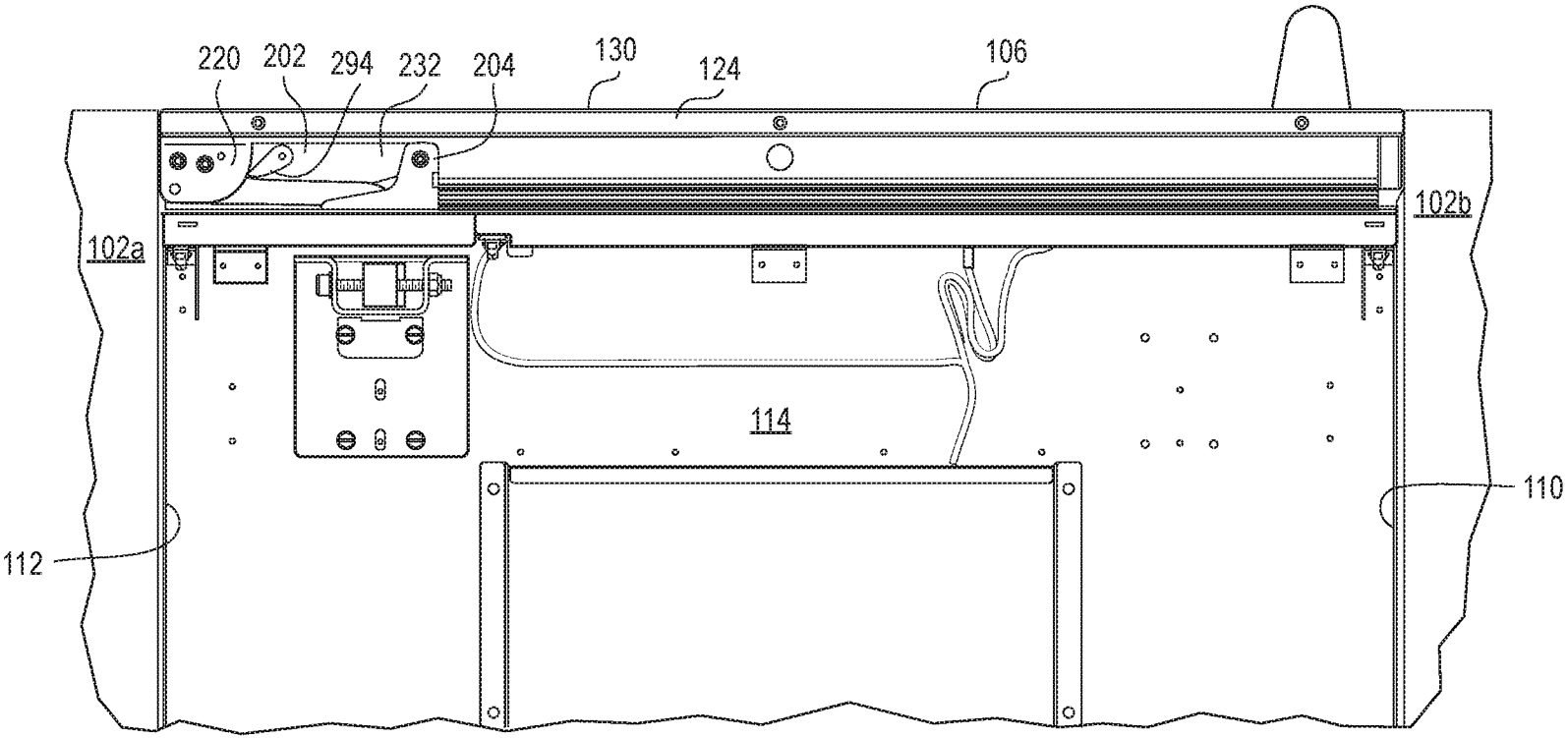
FIGS. 10A-E show various stages of the opening of an embodiment of a door of the refrigerator of FIG. 3 using the hinge of FIGS. 4A-E and 5 a mirror image of the hinge of FIGS. 4A-E and 5 in accordance with the present invention.
Figure 10B:
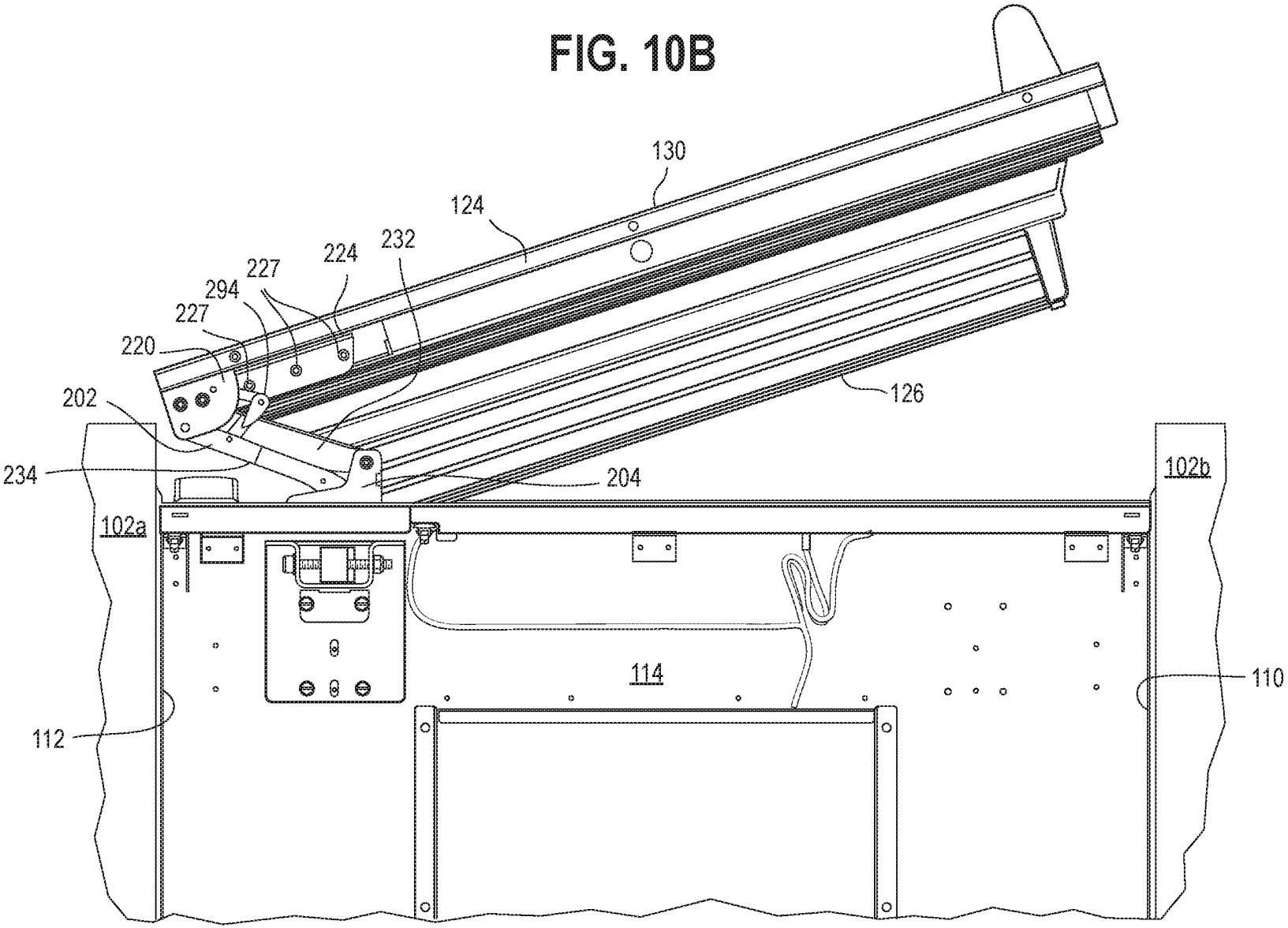
Figure 10C:
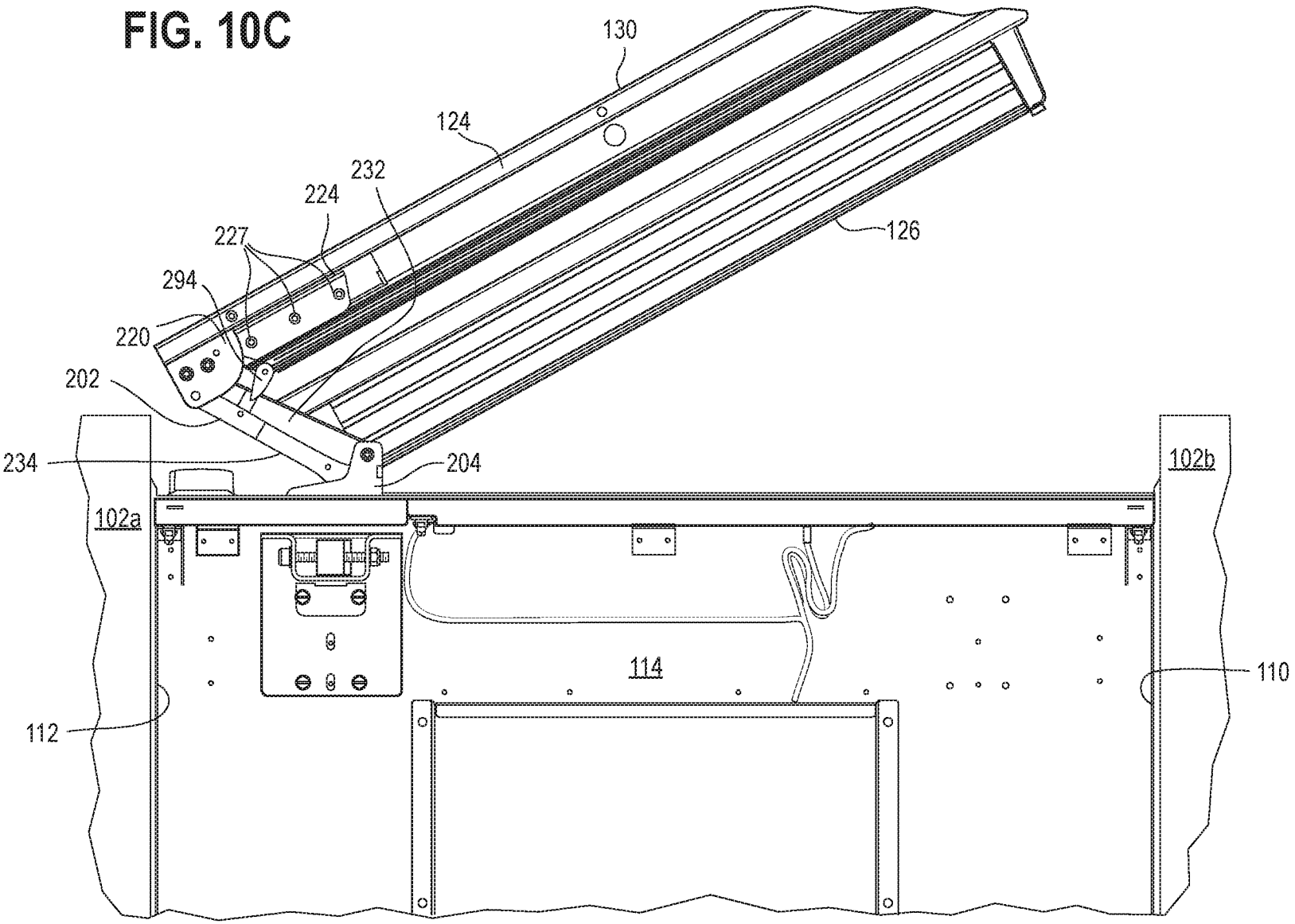
Figure 10D:
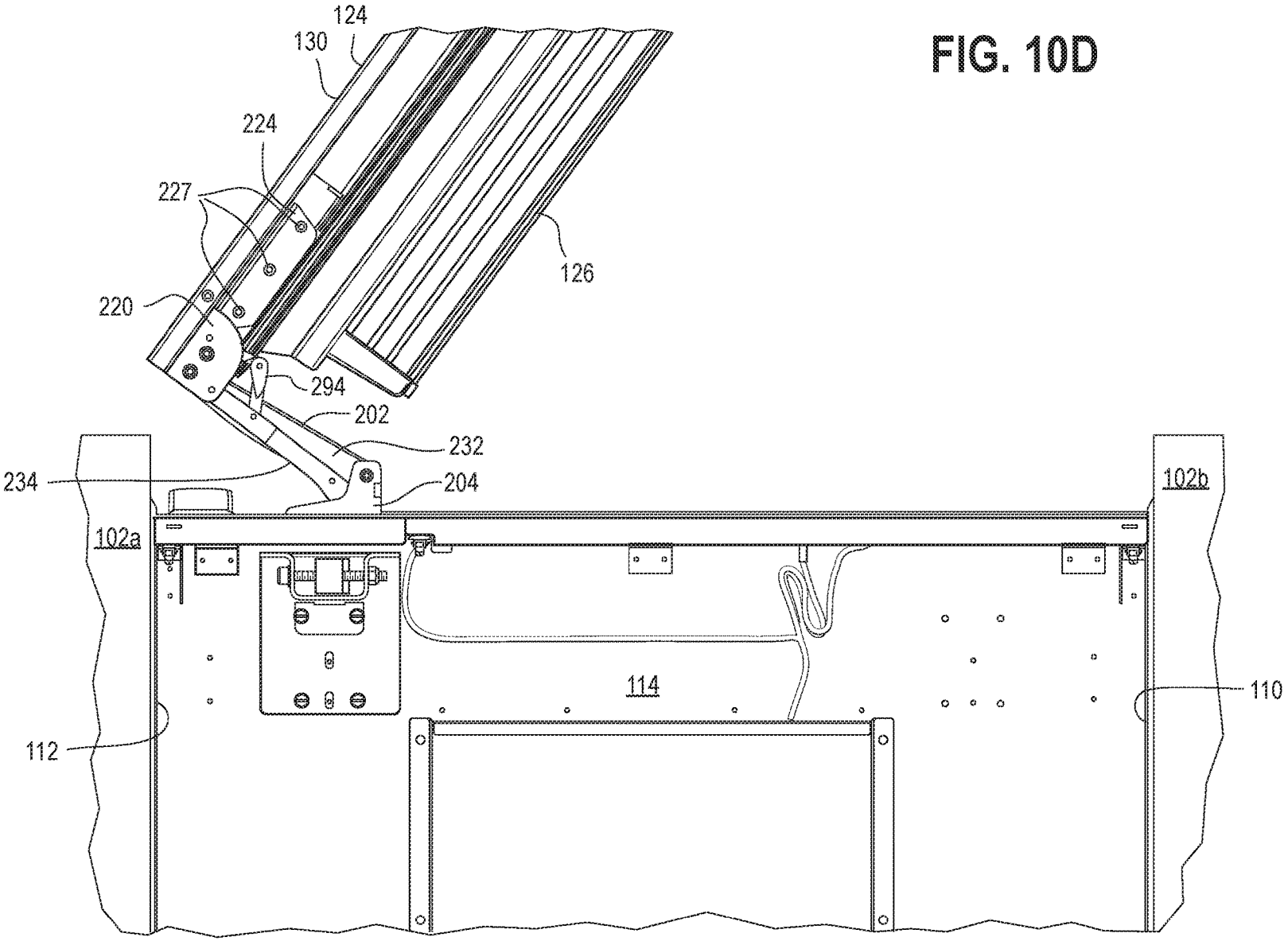
Figure 10E:
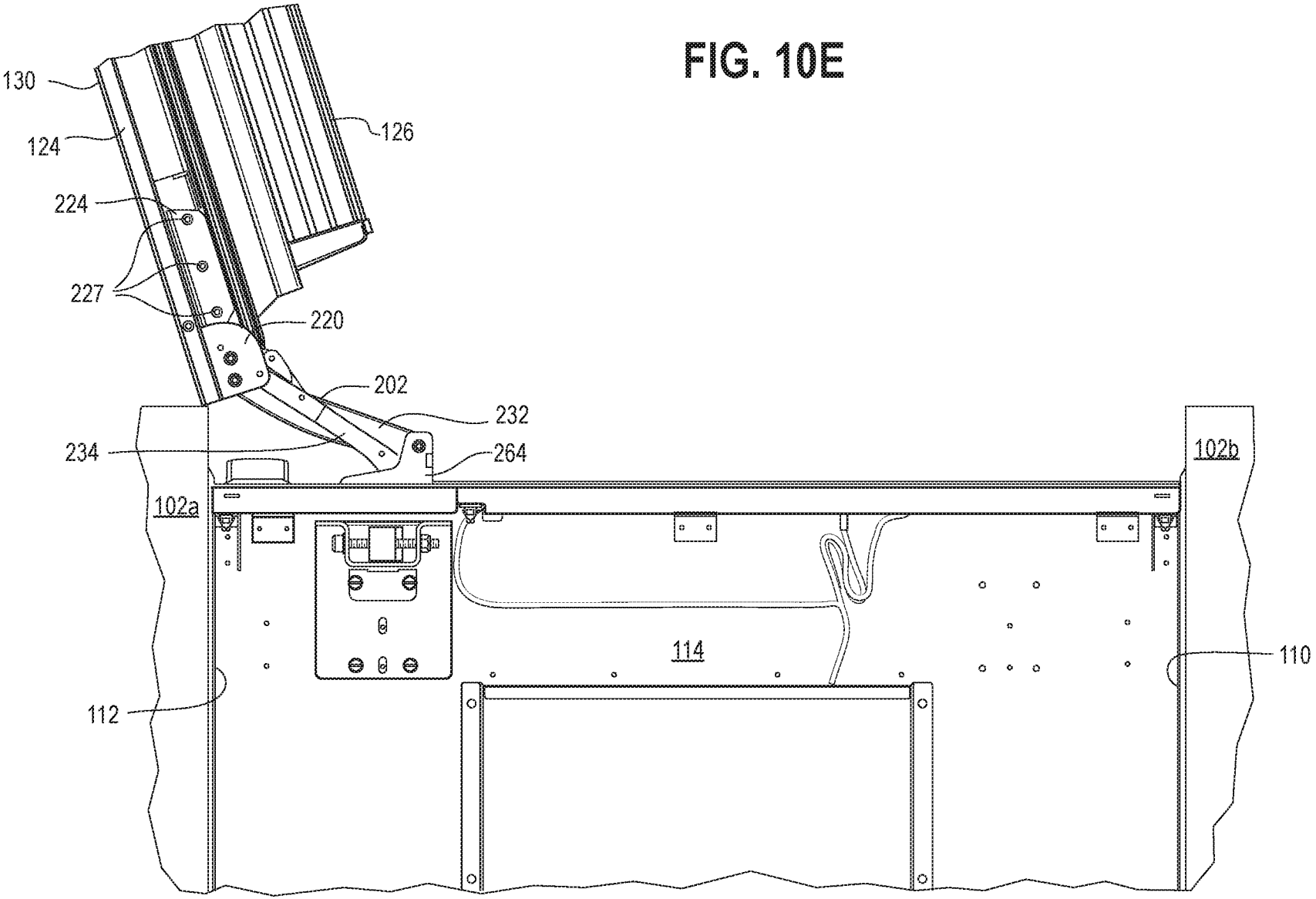
Figure 11A:
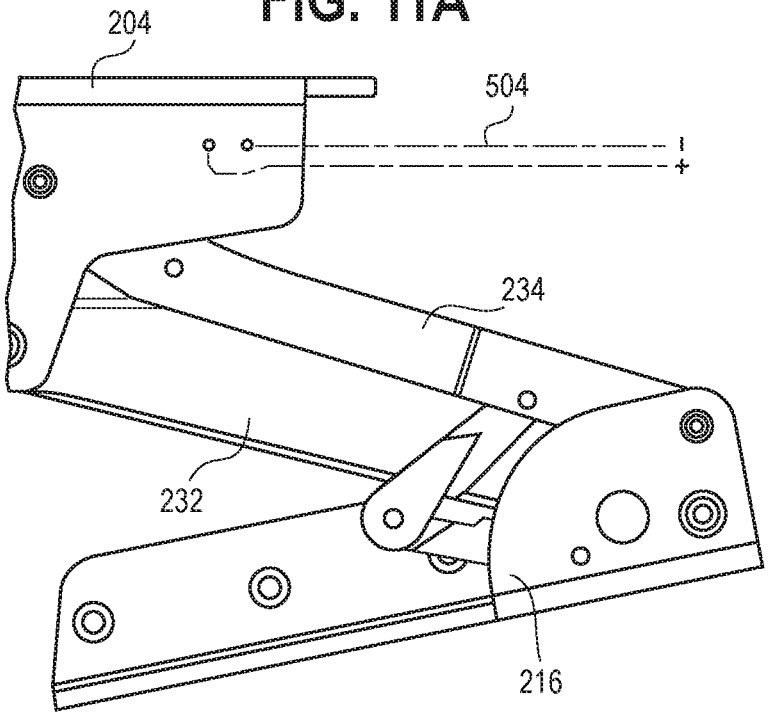
FIG. 11A shows a first state of an embodiment of a door switch when the door of the refrigerator of FIG. 3 is in an open position.
Figure 11B:
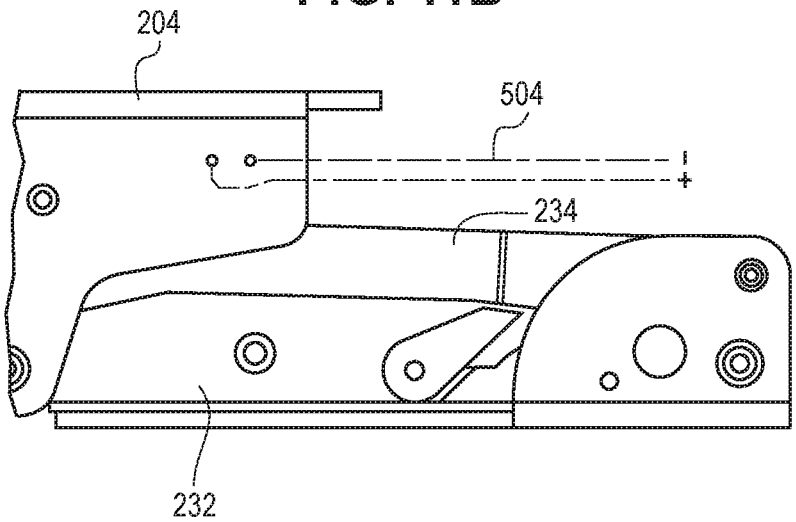
FIG. 11B shows a second state of the door switch of FIG. 11A when the door of the refrigerator of FIG. 3 is in a closed position.

As shown in FIG. 10A, the top hinge 202 is fully retracted so that the door 124 of the refrigerator 106 is in a closed position. In FIG. 10B, the door 124 is opened further, wherein the stop mechanism 294 just starts to appear. FIGS. 10C-10D show further opening of the door 124. FIG. 10E shows the door 124 when fully opened. During the opening process the door is pitched outward while it rotates over center. Note that throughout the whole opening process the door is simultaneously rotated and translated away from the housing 108 of the refrigerator. Furthermore, the hinge 200 and the door 124 never contact the adjoining storage unit 102*a* during the entire opening process. As an additional property of the closing and opening operation, when the door 124 is opened so that door defines an angle of 90 degrees with respect to its starting position, the cavity 118 of the refrigerator 106 is not blocked by the door 124 since the door 124 is moved laterally away from the side wall of the refrigerator 106. Closing of the door 124 involves a reversal of the opening process mentioned previously.

During the above described motion of the door 124, note that the load bearing arm 232 carries a substantial portion of the load of the door 124 while the return arm 234 performs the positioning of the door 124. In addition, when the door stop is acted upon, the door stop withstands a tensile force that is transferred from exterior face 218 to return arm 234.

Figure 12C:
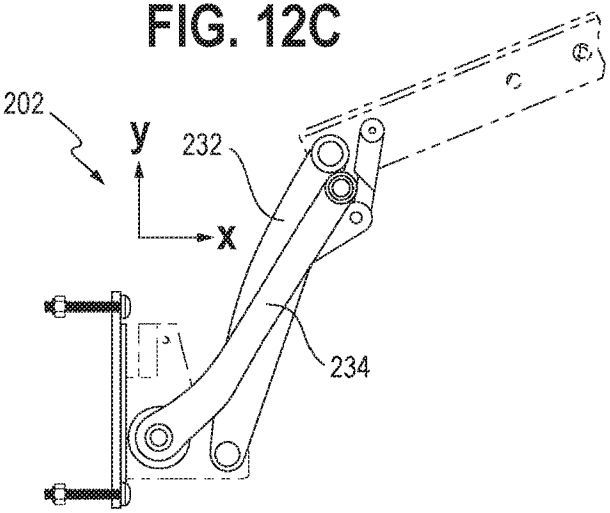
FIGS. 12A-C show various orientations of embodiments of the load bearing arm and the return arm used in the hinge of FIGS. 4A-E in accordance with the present invention.
Figure 12B:
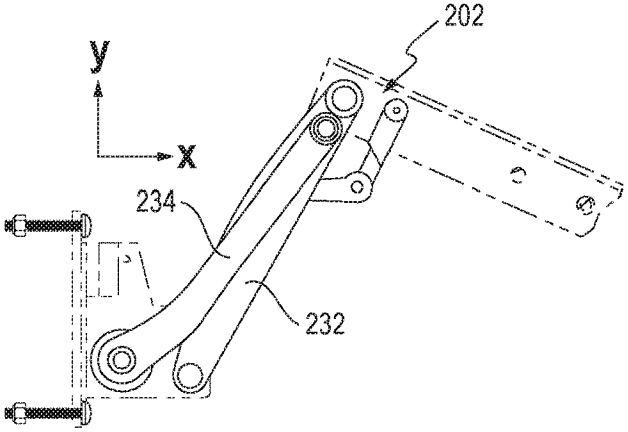
Figure 12A:
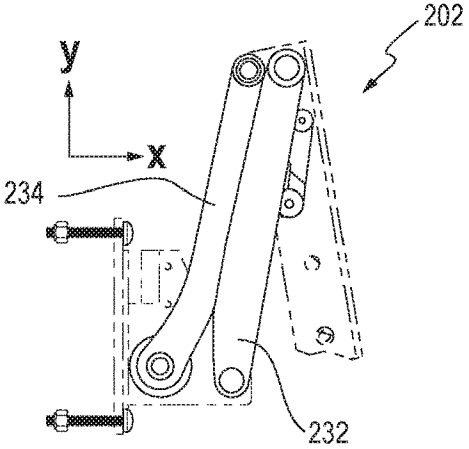
Figure 13A:
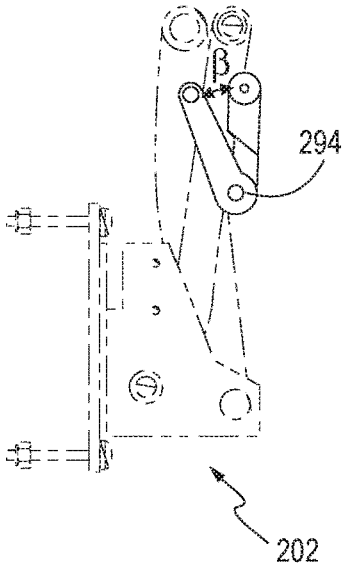
FIGS. 13A-D show various orientations of an embodiment of the stop mechanism used in the hinge of FIGS. 4A-E in accordance with the present invention.
Figure 13B:
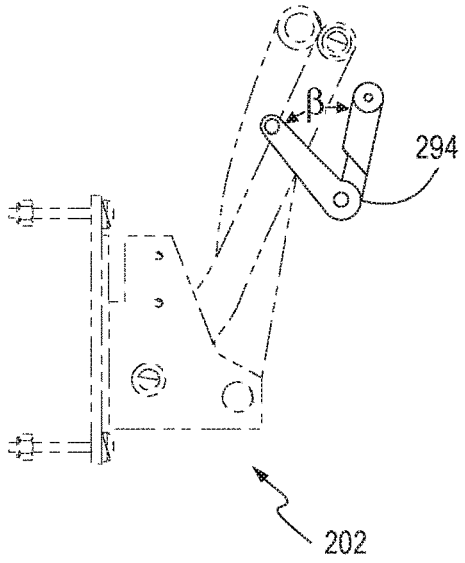
Figure 13C:
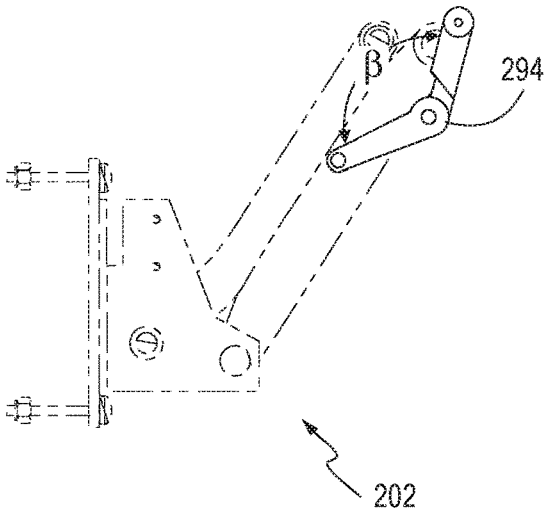
Figure 13D:
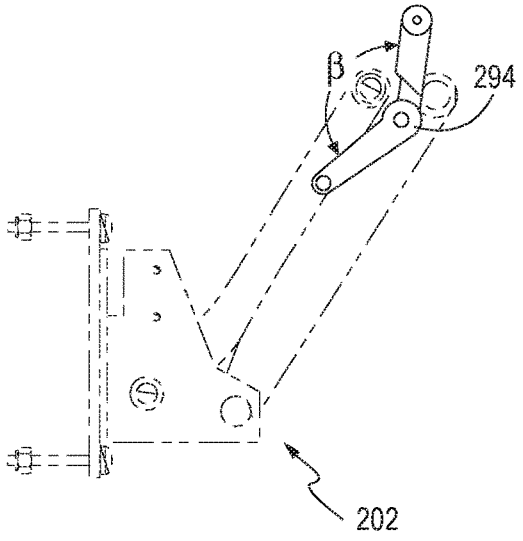

During the above described movement of the door 124 from the closed position to an open position and back again, the load bearing arm and return arm of each hinge 200, 202 move in parallel paths that do not intersect one another. This non-interaction allows for an increase in the maximum radial opening angle of the hinges 200, 202. This mitigates additional stress in addition to cyclic loading from normal service on the load bearing arm 232. However, as shown in FIGS. 12A-C, the ends of the loading arm 232 and the return arm 234 that are attached to the mounting bracket 216 have different positions in the x and y directions shown in the drawings. Thus, the pivot point of the return arm 234 with respect to the mounting bracket 216 is able to move past the load bearing arm 232 during the opening process. One thing to keep in mind during the opening process is that the return arm 234 is biased, via spring 246, for the initial portion of the opening process so as to return the door 124 to the closed position if left unattended. As the door 124 is opened, a transition or over-center point is reached approximately when the levers 296 and 310 of the stop mechanism define an angle β (see FIGS. 13A-D) that has a value of almost 90 degrees right angles to each other. Further opening of the door 124 causes the angle β to further increase and it results in the door 124 not returning to the closed position if left unattended past the transition point. Thus, the hinges and door define a bi-stable system that has the equilibrium states of the door returning to a closed position or the door remaining at an open position.

Note that while loading arm 232 and return arm 234 move during the opening and closing processes, the stop mechanism 294 is also moving as shown in FIGS. 13A-13D, wherein the maximum amount of opening of the door 124 occurs when stop surface 326 contacts engagement surface 328 of stop mechanism 294 so that further movement between the levers 296 and 310 during the opening operation is prevented. When the levers 296 and 310 can no longer move during the opening operation that results in the load bearing arm 232 and the return arm 234 from further opening the door 124.

During usage, there can occur instances when a user "slams" the door open by quickly pulling the door and releasing the handle when the door is still swinging through its arc at nonzero velocity. This extreme case of overloading of the door is an unintended use of the door, where the force applied to the door is likely to otherwise damage the refrigerator door or adjacent cabinetry. It is advantageous for the user to know whether overloading of the door has occurred by the above described process or by other means. This is accomplished by selecting pins 302 and 312 to have a predetermined threshold of stress, wherein should a pin 302, 312 experience a stress above the predetermined threshold, the pin will fail/break. In such a case of failure, a user will be able to visibly see that the pin has broken. In response to seeing a pin is broken, the user will replace the broken pin with an identical pin that has the same predetermined threshold to stress.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. For example, the hinge described herein is used for the door of a refrigerator. It is envisioned that the hinge can be used for other types of storage units and for other structures that include a pivoting door.

We claim:

1. A hinge for a door of a storage unit, said hinge comprising:
a first bracket;
a second bracket;
a linking mechanism for coupling said second bracket to said first bracket so that said second bracket is able to translate and rotate relative to said first bracket, wherein a maximum amount of rotation of said second bracket relative to said first bracket is not determined solely by operation of said linking mechanism, wherein said linking mechanism comprises:
a load bearing arm comprising:
a first end rotatably connected to said first bracket; and
a second end rotatably connected to said second bracket; and
a return arm comprising:
a third end rotatably connected to said first bracket; and
a fourth end rotatably connected to said second bracket, wherein during any instant of time of operation of said linking mechanism, said load bearing arm defines a first path of movement, and said return arm defines a second path of movement that does not intersect said first path of movement, wherein said first path of movement is parallel to said second path of movement.

2. A hinge for a door of a storage unit, said hinge comprising:
a first bracket;
a second bracket;
a linking mechanism for coupling said second bracket to said first bracket so that said second bracket is able to translate and rotate relative to said first bracket, wherein a maximum amount of rotation of said second bracket relative to said first bracket is not determined solely by operation of said linking mechanism; and
a stop mechanism that interacts with said linking mechanism so as to determine said maximum amount of rotation of said second bracket relative to said first bracket, wherein said stop mechanism moves relative to said first bracket and said second bracket.

3. The hinge of claim 2, wherein said stop mechanism is rotatable relative to said first bracket and said second bracket.

4. A hinge for a door of a storage unit, said hinge comprising:
a first bracket;
a second bracket;
a linking mechanism for coupling said second bracket to said first bracket so that said second bracket is able to translate and rotate relative to said first bracket, wherein a maximum amount of rotation of said second bracket relative to said first bracket is not determined solely by operation of said linking mechanism, wherein said linking mechanism comprises:
a load bearing arm comprising:
a first end rotatably connected to said first bracket; and
a second end rotatably connected to said second bracket; and
a return arm comprising:
a third end rotatably connected to said first bracket; and
a fourth end rotatably connected to said second bracket, wherein during any instant of time of operation of said linking mechanism, said load bearing arm defines a first path of movement, and said return arm defines a second path of movement that does not intersect said first path of movement; and
a stop mechanism that interacts with said linking mechanism so as to determine said maximum amount of rotation of said second bracket relative to said first bracket, wherein said stop mechanism moves relative to said first bracket and said second bracket.

5. The hinge of claim 4, further comprising a spring that is coupled to said return arm so as to bias said return arm to rotate in a return direction toward a closed position.

6. The hinge of claim 4, wherein said stop mechanism is rotatable relative to said first bracket and said second bracket.

7. A hinge for a door of a storage unit, said hinge comprising:
a first bracket;
a second bracket;
a linking mechanism for coupling said second bracket to said first bracket so that said second bracket is able to translate and rotate relative to said first bracket, wherein a maximum amount of rotation of said second bracket relative to said first bracket is not determined solely by operation of said linking mechanism, wherein said linking mechanism comprises:
a load bearing arm comprising:
a first end rotatably connected to said first bracket; and
a second end rotatably connected to said second bracket; and
a return arm comprising:
a third end rotatably connected to said first bracket; and
a fourth end rotatably connected to said second bracket, wherein during any instant of time of operation of said linking mechanism, said load bearing arm defines a first path of movement, and said return arm defines a second path of movement that does not intersect said first path of movement
a stop mechanism that interacts with said linking mechanism so as to determine said maximum amount of rotation of said second bracket relative to said first bracket, wherein said stop mechanism comprises:
a first lever, wherein a first end of said first lever is rotatably attached to said return arm and a second end of said first lever comprises a stop surface;
a second lever, wherein a first end of said second lever is rotatably attached to said second bracket and a second end of said second lever is rotatably coupled to said second end of said first lever, wherein when said maximum amount of rotation of said second bracket relative to said first bracket is achieved said stop surface engages with a surface of said second lever.

8. The hinge of claim 7, wherein said stop mechanism comprises a first pin that is attached to either said first lever and said return arm or said second lever and said second bracket, wherein should said stop mechanism encounter an overload, said first pin can be removed.

9. The hinge of claim 7, wherein said stop mechanism comprises a pin that is attached to said first lever and said second lever, wherein said pin indicates when said stop mechanism encounters an overload.

10. The hinge of claim 9, wherein said pin indicates an overload by breaking.

11. A hinge for a door of a storage unit, said hinge comprising:

a first bracket;

a second bracket;

a linking mechanism for coupling said second bracket to said first bracket so that said second bracket is able to translate and rotate relative to said first bracket, wherein said linking mechanism comprises:

a load bearing arm comprising:

a first end rotatably connected to said first bracket; and a second end rotatably connected to said second bracket; and a return arm comprising:

a third end rotatably connected to said first bracket; and a fourth end rotatably connected to said second bracket, wherein said fourth end rotates about an axis relative to said second bracket; and an adjustable biasing mechanism that is coupled to said linking mechanism and which adjusts a load applied to said linking mechanism so as to move said first bracket in a particular direction, wherein said adjustable biasing mechanism comprises:

a spring that is attached to said return arm and engages said second bracket, wherein said spring is coiled and wound around said axis; and a movable element that adjusts an amount of compression of said spring by engaging and moving a free end of said spring so that said load is adjusted.

12. The hinge of claim 11, wherein during any instant of time of operation of said linking mechanism, said load bearing arm defines a first path of movement, and said return arm defines a second path of movement that does not intersect said first path of movement.

* * * * *